US007437868B2

(12) United States Patent
Baba et al.

(10) Patent No.: US 7,437,868 B2
(45) Date of Patent: Oct. 21, 2008

(54) CORE YARN MANUFACTURING APPARATUS

(75) Inventors: Kenji Baba, Kyoto (JP); Hisakatsu Imamura, Uji (JP); Katsuya Tanaka, Kyoto (JP); Satoshi Enami, Otsu (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 156 days.

(21) Appl. No.: 11/417,139

(22) Filed: May 4, 2006

(65) Prior Publication Data

US 2006/0191253 A1 Aug. 31, 2006

(30) Foreign Application Priority Data

May 23, 2005 (JP) ..... 2005-149244
May 23, 2005 (JP) ..... 2005-149245
May 23, 2005 (JP) ..... 2005-149246
Jun. 2, 2005 (JP) ..... 2005-162610

(51) Int. Cl.
*D02G 3/36* (2006.01)

(52) U.S. Cl. ..... 57/5; 57/6; 57/224; 57/225

(58) Field of Classification Search ..... 57/3, 57/5, 6, 10, 12, 18, 210, 224, 225
See application file for complete search history.

(56) References Cited

U.S. PATENT DOCUMENTS 4,848,072 A * 7/1989 Sakai et al. ..... 57/261
5,619,848 A * 4/1997 Costales et al. ..... 57/261
6,318,060 B1 * 11/2001 Dinkelmann et al. ..... 57/3
6,405,519 B1 * 6/2002 Shaikh et al. ..... 57/210
6,655,122 B2 * 12/2003 Shigeyama et al. ..... 57/5
2003/0205041 A1 * 11/2003 Baker, Jr. ..... 57/224

FOREIGN PATENT DOCUMENTS

JP 2002-69760 3/2002
JP 2002-363831 12/2002

* cited by examiner

*Primary Examiner*—Shaun R Hurley
(74) *Attorney, Agent, or Firm*—Westerman, Hattori, Daniels & Adrian, LLP.

(57) ABSTRACT

A core yarn manufacturing apparatus includes a draft device that drafts sheath fibers of a core yarn and a core fiber supply device that supplies core fibers of the core yarn, wherein a feed-out path of the core fibers in the core fiber supply device is inclined above the draft device in such a manner that a front of the feed-out path is lower than a rear of the feed-out path with respect to a front surface of a machine frame, and wherein a CSY wind-out device and a CFY yarn guide are provided in a rear upper part of a base frame of the core fiber supply device, the wind-out device supporting a CSY package and winding out an elastic yarn, the yarn guide guiding a filament yarn drawn out from a CFY package located behind the core fiber supply device.

6 Claims, 20 Drawing Sheets

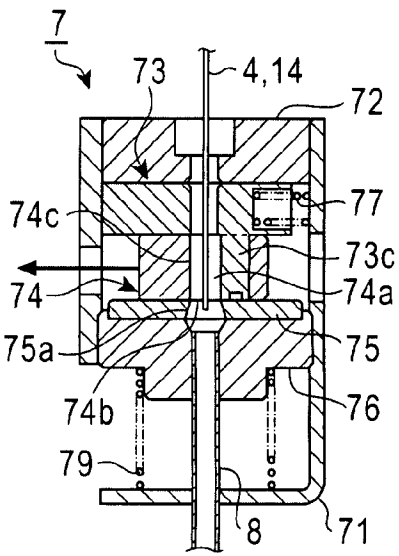
FIG. 11D1
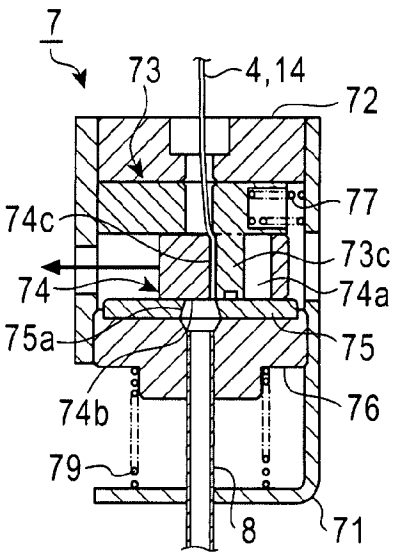
FIG. 11C1
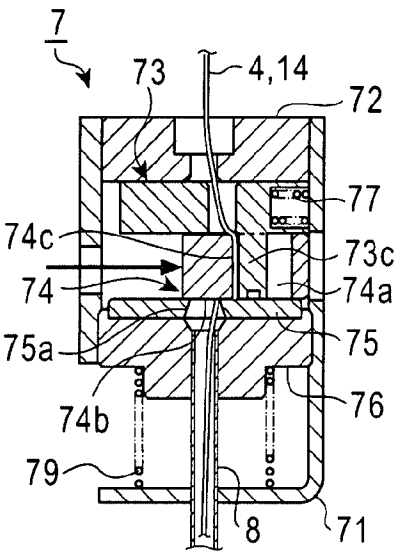
FIG. 11B1
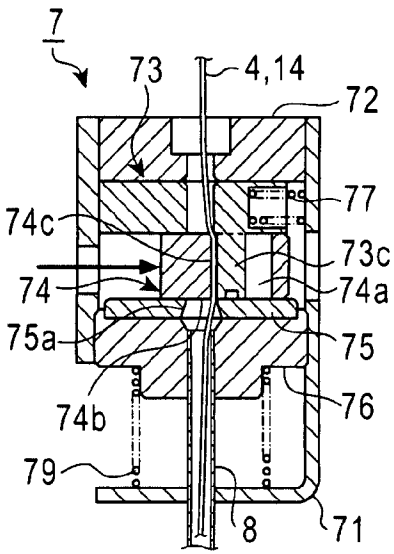
FIG. 11A1
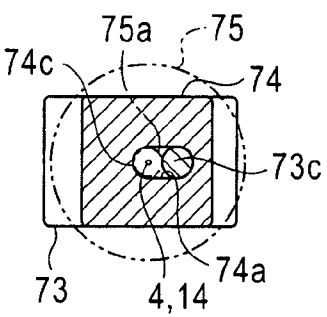
FIG. 11D2
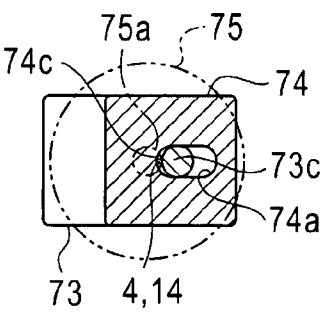
FIG. 11C2
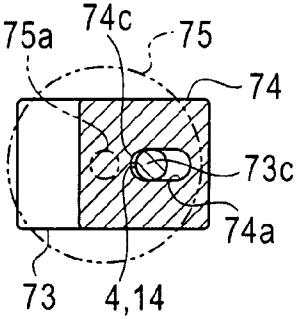
FIG. 11B2
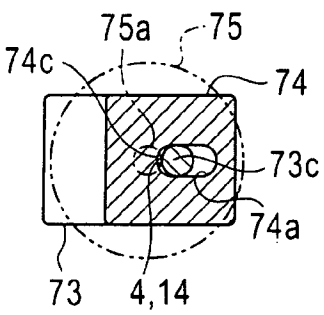
FIG. 11A2

CORE YARN MANUFACTURING APPARATUS

FIELD OF THE INVENTION

The present invention relates to a core yarn manufacturing apparatus comprising a draft device that drafts sheath fibers of a core yarn and a core fiber supply device that supplies core fibers of the core yarn.

BACKGROUND OF THE INVENTION

Conventional core yarn manufacturing apparatuses are classified into two types according to the types of core fibers. One of the two types of automatic apparatuses manufactures a CSY (Core Spandex (registered trade mark) Yarn) using an elastic yarn as core fibers. The other type manufactures a CFY (Core Filament Yarn) using a filament yarn as core fibers. The Unexamined Japanese Patent Application Publication (Tokkai) 2002-363831 discloses an example of a CSY manufacturing apparatus, and the Unexamined Japanese Patent Application Publication (Tokkai) 2002-69760 discloses an example of a CFY manufacturing apparatus.

The core spandex yarn is hereinafter referred to as the "CSY", and the core filament yarn is hereinafter referred to as the "CFY".

The CSY and CFY manufacturing apparatuses are exclusive to each other in the respects described below and thus have poor general purpose properties.

First, the CSY and CFY manufacturing apparatuses use differently configured feed-out devices that unwind and feed out core fibers from a package. The CSY manufacturing apparatus comprises a friction roller type yarn feed-out device that can appropriately unwind an elastic yarn. On the other hand, the CFY manufacturing apparatus simply draws in a filament yarn from a package. This prevents the CFY manufacturing apparatus from being used to supply an elastic yarn.

Second, the CSY and CFY manufacturing apparatuses involve different yarn paths of core fibers. In the CSY manufacturing apparatus, core fibers are generally inserted into a draft device for sheath fibers from immediately above, and the core fibers are fed out (inserted) in a direction nearly perpendicular to a direction in which sheath fibers are fed out; these directions form a sharp angle. On the other hand, in the CFY manufacturing apparatus, the feed-out direction of the core fibers is nearly parallel to that of the sheath fibers; these directions form an obtuse angle. Thus, when an attempt is made to supply a filament yarn using the core fiber supply device provided in the CSY manufacturing apparatus, a yarn drawn out from a package provided separately from the core fiber supply device is guided to immediately above the draft device and then fed out downward. This may markedly bend the yarn path to damage the yarn.

The problem to be solved by the present invention is thus that the CSY and CFY manufacturing apparatuses are exclusive to each other and thus have poor general purpose properties.

SUMMARY OF THE INVENTION

A description has been given of the problem to be solved by the present invention, and a description will be given below of means for solving the problem.

The first aspect of the present invention sets forth a core yarn manufacturing apparatus comprising a draft device that drafts sheath fibers of a core yarn and a core fiber supply device that supplies core fibers of the core yarn, wherein the core fiber supply device is configured so that a feed-out path of the core fibers in the core fiber supply device is inclined above the draft device in such a manner that a front of the feed-out path is lower than a rear of the feed-out path with respect to a front surface side of a machine frame, and wherein a wind-out device and a yarn guide are provided in a rear upper part of a base frame of the core fiber supply device, the wind-out device supporting an elastic yarn package and winding out the core fibers constituting an elastic yarn, the yarn guide guiding the core fibers drawn out from a filament yarn package located behind the core fiber supply device, the core fibers constituting a filament yarn.

According to the second aspect of the present invention, the core yarn manufacturing apparatus further comprises a moving mechanism that is able to move the base frame upward with respect to the draft device.

According to the third aspect of the present invention, the wind-out device and yarn guide are laid out so that, in the core fiber supply device, a feed-out path of the elastic yarn starting from the wind-out device overlaps a feed-out path of the filament yarn starting from the yarn guide, and a clamp cutter for the core fibers and an air sucker that feeds the core fibers out to the clamp cutter are arranged on the feed-out path of the elastic yarn.

The fourth aspect of the present invention sets forth a core fiber supply device that operates in manufacturing a core yarn formed of core fibers covered with sheath fibers, to supply the core fibers, the device comprising modules relating to supply of the core fibers and a base frame to which each of the modules is attached, wherein each of the modules is configured to be able to attach to the base frame so as to form an individual unit.

According to the fifth aspect of the present invention, the modules comprise CSY modules used where an elastic yarn is used as the core fibers and CFY modules used where a filament yarn is used as the core fibers, each CSY module comprises a CSY feed-out device which supports an elastic yarn package and which feeds out the elastic yarn, a CSY clamp cutter, a CSY yarn feeler, and a CSY air sucker, and each CFY module comprises a CFY yarn guide that guides a filament yarn drawn out from a filament yarn package, a CFY clamp cutter, a CFY yarn feeler, and a CFY air sucker.

According to the sixth aspect of the present invention, the CSY clamp cutter is also used as the CFY clamp cutter, the CSY yarn feeler is also used as the CFY yarn feeler, and the CSY air sucker and the CFY air sucker are selectively attached to the base frame.

The seventh aspect of the present invention sets forth a clamp cutter provided in a device that operates in manufacturing a core yarn formed of core fibers covered with sheath fibers, to supply the core fibers, the clamp cutter comprising a support frame, a follower clamp piece and an operating clamp piece which are movably supported by the support frame in a direction crossing the feed-out path, an actuator that moves the operating clamp piece forward and backward in a direction crossing a feed-out path of the core fibers, follower urging means for urging the follower clamp piece in one direction in the above described direction, a movable blade fixed to the operating clamp piece, and a fixed blade placed on a downstream side, in the feed-out path, of the follower clamp piece and the operating clamp piece and fixed to the support frame, wherein the follower clamp piece and the operating clamp piece constitute a clamp that sandwiches the core fibers, and the movable blade and the fixed blade constitute a cutter that cuts the core fibers, and wherein when the operating clamp piece is located so as to push in the follower clamp piece against an urging force of the follower urging means, the movable blade and the fixed blade are closed.

According to the eighth aspect of the present invention, the clamp cutter further comprises cutter urging means for pushing the fixed blade against the movable blade in a direction along the feed-out path.

According to the ninth aspect of the present invention, a first moving member and a second moving member are arranged parallel to each other along the feed-out path, and the first moving member is provided with a first passage hole through which the core fibers pass and a projecting portion that projects toward the second moving member side, and the second moving member is provided with a second passage hole into which the projecting portion is inserted so as to be movable in the above described direction and through which the core fibers pass, and the follower clamp piece corresponds to the projecting portion, while the operating clamp piece corresponds to an area located opposite the projecting portion across the feed-out path in the second moving member.

The tenth aspect of the present invention sets forth a core yarn manufacturing apparatus comprising a multi-line draft device that drafts sheath fibers of a core yarn, an elastic yarn supply device that supplies an elastic yarn constituting core fibers of the core yarn, a guide pipe that sets a rush-in position at which the elastic yarn rushes into the draft device, and an air sucker that blows the elastic yarn out of the guide pipe toward the rush-in position, wherein an outlet of the guide pipe is shaped to be elongate in a feed-out direction of the sheath fibers in the draft device.

According to the eleventh aspect of the present invention, the rush-in position is set on an outer peripheral surface of a front top roller, and the guide pipe is laid out with respect the draft device so that a substantially axial position of the front top roller is located on an extension of a rush-in path of the elastic yarn which extends from the outlet of the guide pipe to the rush-in position.

According to the twelfth aspect of the present invention, the outlet of the guide pipe is shaped to be elliptical.

The present invention produces the following effects.

The apparatus in accordance with the first aspect of the present invention can deal with core fibers whether they constitute an elastic yarn or a filament yarn. The apparatus thus has improved general purpose properties.

The apparatus in accordance with the second aspect of the present invention not only produces the effect of the first aspect of the present invention but also enables the core fiber supply device to withdraw to above the draft device as required. This improves the maintainability of the draft device.

The apparatus in accordance with the third aspect of the present invention not only produces the effects of the first and second aspects of the present invention but also reduces the number parts required while ensuring general purpose properties required to deal with different core fibers.

The device in accordance with the fourth aspect of the present invention allows the modules to be easily installed, removed, and replaced.

The device in accordance with the fifth aspect of the present invention not only produces the effect of the fourth aspect of the present invention but also enables the modules to be arbitrarily combined into a supply device used for both elastic yarns and filament yarns, a supply device dedicated for elastic yarns, or a supply device dedicated for filament yarns. This provides the core fiber supply device with improved general purpose properties.

The device in accordance with the sixth aspect of the present invention not only produces the effect of the fifth aspect of the present invention but also reduces the number of parts required, while ensuring general purpose properties required to deal with different core fibers.

The clamp cutter in accordance with the seventh aspect of the present invention enables the appropriate setting of driving timings for the clamp and cutter as well as a reduction in the number of actuators required.

The clamp cutter in accordance with the eighth aspect of the present invention not only produces the effect of the seventh aspect of the present invention but also maintains the performance of the cutter in spite of aging.

The clamp cutter in accordance with the ninth aspect of the present invention not only produces the effects of the seventh and eighth aspects of the present invention but also keeps the feed-out path of the core fibers airtight. Thus, no problems occur even if the air sucker is used to pneumatically feed out the core fibers along the feed-out path.

The core yarn manufacturing apparatus in accordance with the tenth aspect of the present invention stabilizes the behavior of a yarn inserted into the sheath fibers. This increases the success rate of insertion of an elastic yarn into the sheath fibers.

The core yarn manufacturing apparatus in accordance with the eleventh aspect of the present invention not only produces the effect of the tenth aspect of the present invention but also minimizes the adverse effect of air ejected from the guide pipe, on the sheath fibers in the draft device. This increases the success rate of insertion of an elastic yarn into the sheath fibers.

The core yarn manufacturing apparatus in accordance with the twelfth aspect of the present invention stabilizes the behavior of a yarn inserted into the sheath fibers. This increases the success rate of insertion of an elastic yarn into the sheath fibers.

BRIEF DESCRIPTION OF THE DRAWINGS

FIG. 7 is a side view showing two positions between which the core fiber supply device can be switched.

FIG. 10 is a sectional view showing the configuration of the clamp cutter.

FIG. 11 is a diagram showing operational steps of the clamp cutter; FIG. 11A shows a halting step, FIG. 11B shows a pre-cut clamp step, FIG. 11C shows a clamp cut step, and FIG. 11D shows a post-cut clamp step.

FIG. 13 is a diagram showing operational steps of the clamp cutter in accordance with the second embodiment.

FIG. 15 is a diagram showing the configuration of an insertion guide;

DETAILED DESCRIPTION OF THE PREFERRED EMBODIMENTS

A description will be given below of a core yarn manufacturing apparatus in accordance with an embodiment of the present invention. The core yarn manufacturing apparatus manufactures a core yarn composed of core fibers covered with sheath fibers. The cone yarn manufacturing apparatus comprises a draft device that drafts the sheath fibers, core fiber supply device that supplies the core fibers, and a fine spinning device that spins the sheath fibers into which the core fibers have been inserted, to form a core yarn.

Figure 1:
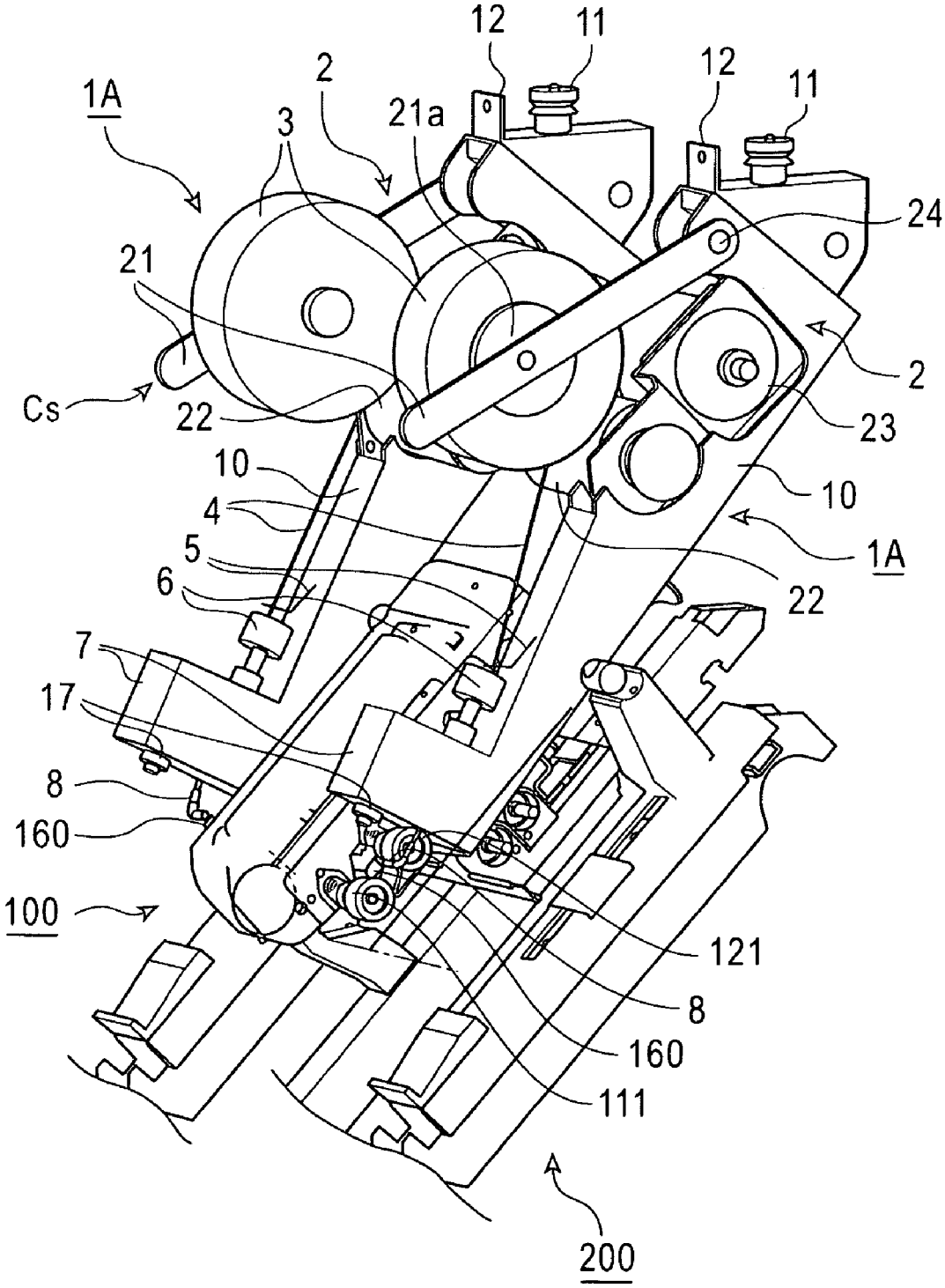
FIG. 1 is a perspective view showing that a core fiber supply device is used as a CSY supply device.
Figure 2:
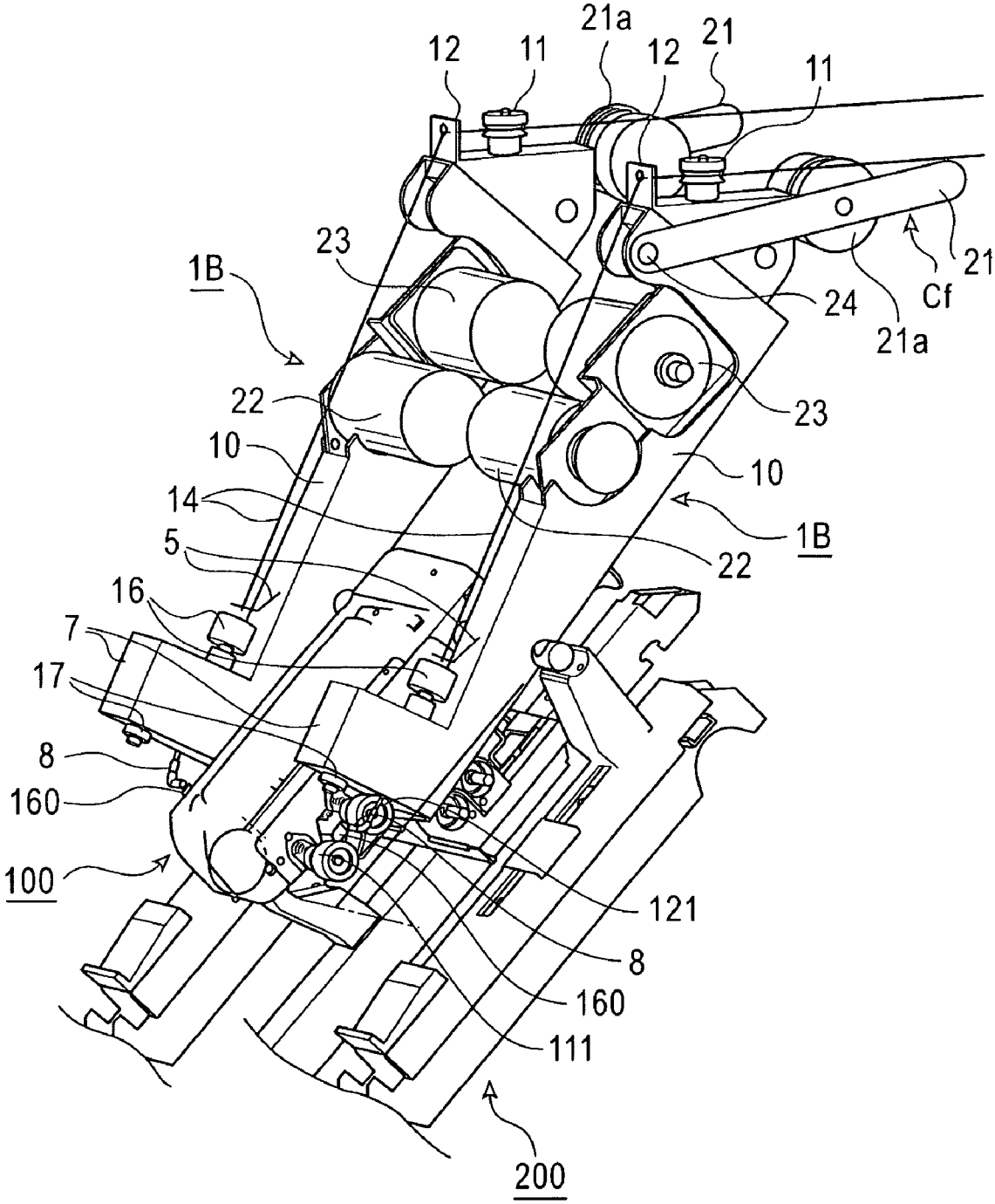
FIG. 2 is a perspective view showing that a core fiber supply device is used as a CFY supply device.

FIGS. 1 and 2 each show two core fiber supply devices 1 and a draft device 100 for two core yarns. The core yarn manufacturing apparatus is composed of a large number of core yarn manufacturing units that manufacture one core yarn, and a driving device that drives all these core yarn manufacturing units, and a control device that controls all these core yarn manufacturing units. Accordingly, the two core fiber supply devices 1 and the draft device 100 for two core yarns, shown in FIGS. 1 and 2, partly constitute two core yarn manufacturing units.

The core fiber supply device 1 can be used as a supply device for elastic yarns (hereinafter referred to as a CSY supply device 1A) or a supply device for filament yarns (hereinafter referred to as a CFY supply device 1B). A CSY (core elastic yarn) is a core yarn formed using an elastic yarn as core fibers. A CFY (core filament yarn) is a core yarn formed using a filament yarn as core fibers.

Figure 3:
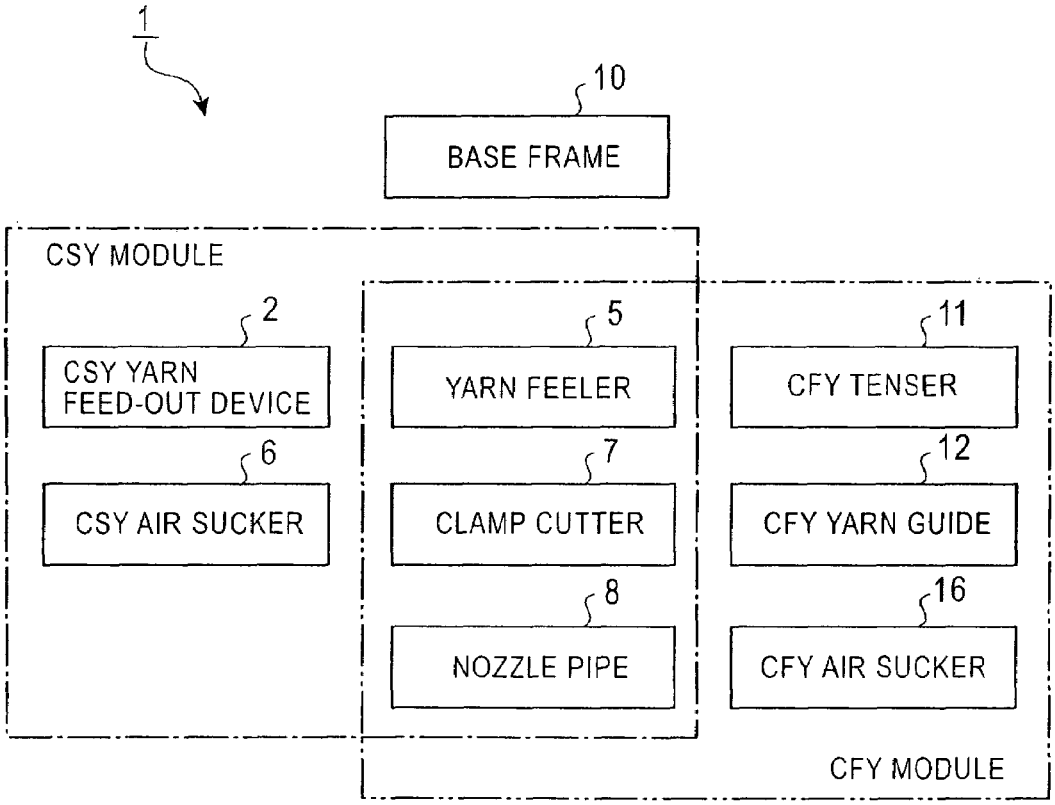
FIG. 3 is a block diagram showing the configuration of the core fiber supply device.

The configuration of the core fiber supply device 1 will be described in brief with reference to FIG. 3. The core fiber supply device 1 comprises CSY modules relating to the supply of an elastic yarn 4 and CFY modules relating to the supply of a filament yarn 14. The CSY modules constitute the CSY supply device 1A and are composed of a CSY feed-out device 2, a yarn feeler 5, a CSY air sucker 6, a clamp cutter 7, and a nozzle pipe 8. The CFY modules constitute a CFY supply device 1B and are composed of a CFY tenser 11, a CFY yarn guide 12, a yarn feeler 5, a CFY air sucker 16, a clamp cutter 7, and a nozzle pipe 8. The yarn feeler 5, clamp cutter 7, and nozzle pipe 8 are shared by the CSY and CFY modules.

The modules (CSY and CFY modules) are formed as individual units and are individually attachable to a base frame 10 of the core fiber supply device 1. More specifically, each of the modules is supported by an attaching frame used to attach the module to the base frame 10. Simply attaching the attaching frame to the base frame 10 allows the module supported by the attaching frame to be attached to the base frame 10.

Most of the modules can be simultaneously attached to the base frame 10. The CSY air sucker 6 and CFY air sucker 16 are the modules that cannot be attached to the base frame 10 simultaneously with the other modules. These modules (CSY air sucker 6 and CFY air sucker 16) can be selectively attached to the base frame 10.

The core fiber supply device 1 can thus be constituted into a CSY-only core fiber supply device, a CFY-only core fiber supply device, or a CSY/CFY core fiber supply device. The CSY-only core fiber supply device is composed only of all CSY modules attached to the base frame 10. The CFY-only core fiber supply device is composed only of all CFY modules attached to the base frame 10. The CSY/CFY core fiber supply device is composed of most of the CSY and CFY modules attached to the base frame 10. As previously described, even with the CSY/CFY core fiber supply device, the CSY air sucker 6 and the CFY air sucker 16 are selectively attached to the base frame 10. The yarn feeler 5, clamp cutter 7, and nozzle pipe 8 are also shared by the CSY and CFY modules. Thus, with the CSY/CFY core fiber supply device, for the yarn feeler 5, clamp cutter 7, and nozzle pipe 8, a single module is attached to the base frame 10.

The CSY supply device 1A supplies the elastic yarn 4 and may be the CSY-only core fiber supply device or the CSY/CFY core fiber supply device with the CSY air sucker 6 attached to the base module 10. Similarly, the CFY supply device supplies the filament yarn 14 and may be the CFY-only core fiber supply device or the CSY/CFY core fiber supply device with the CFY air sucker 16 attached to the base module 10.

Figure 4:
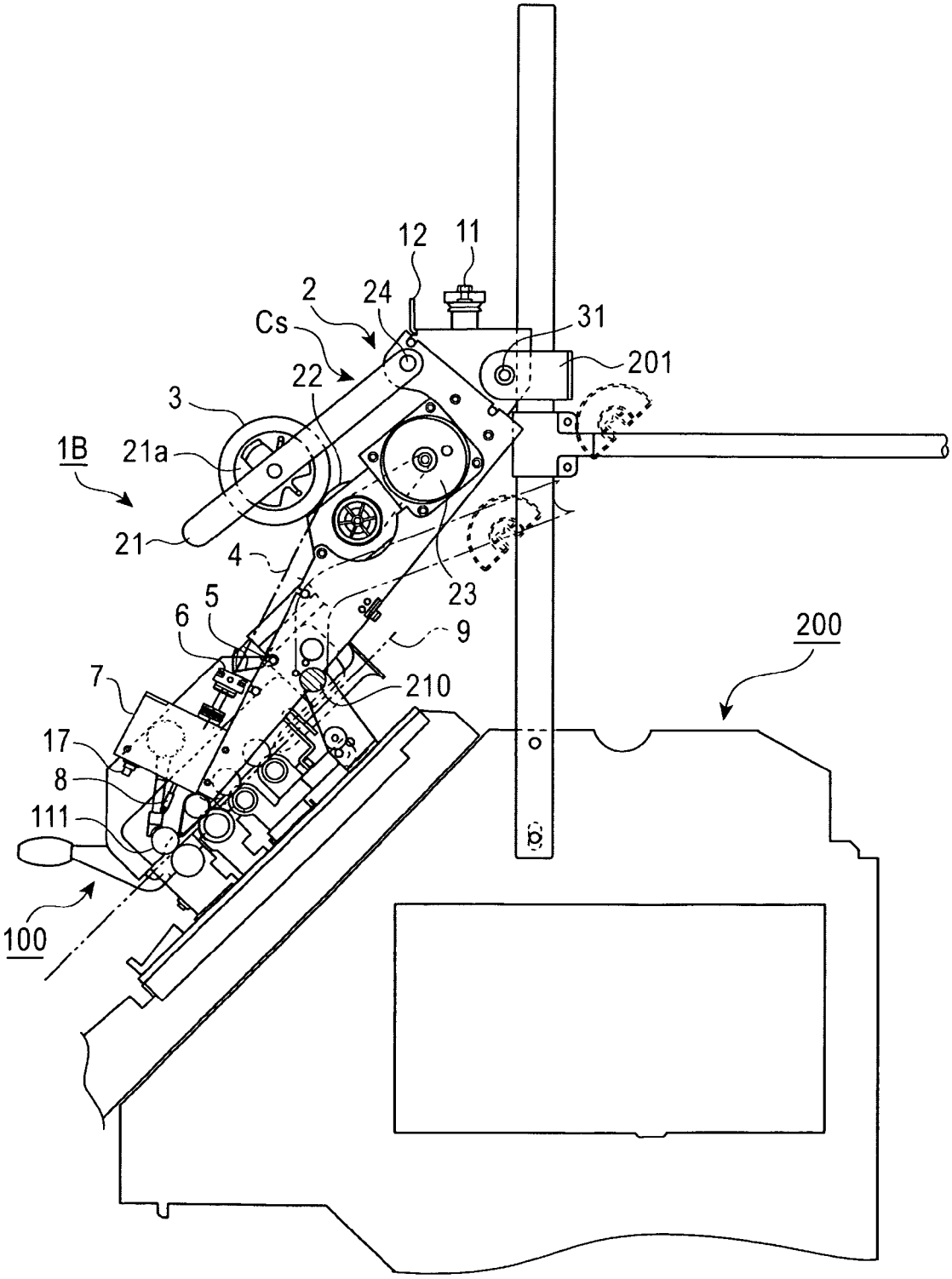
FIG. 4 is a side view showing that the core fiber supply device is used as a CSY supply device.
Figure 5:
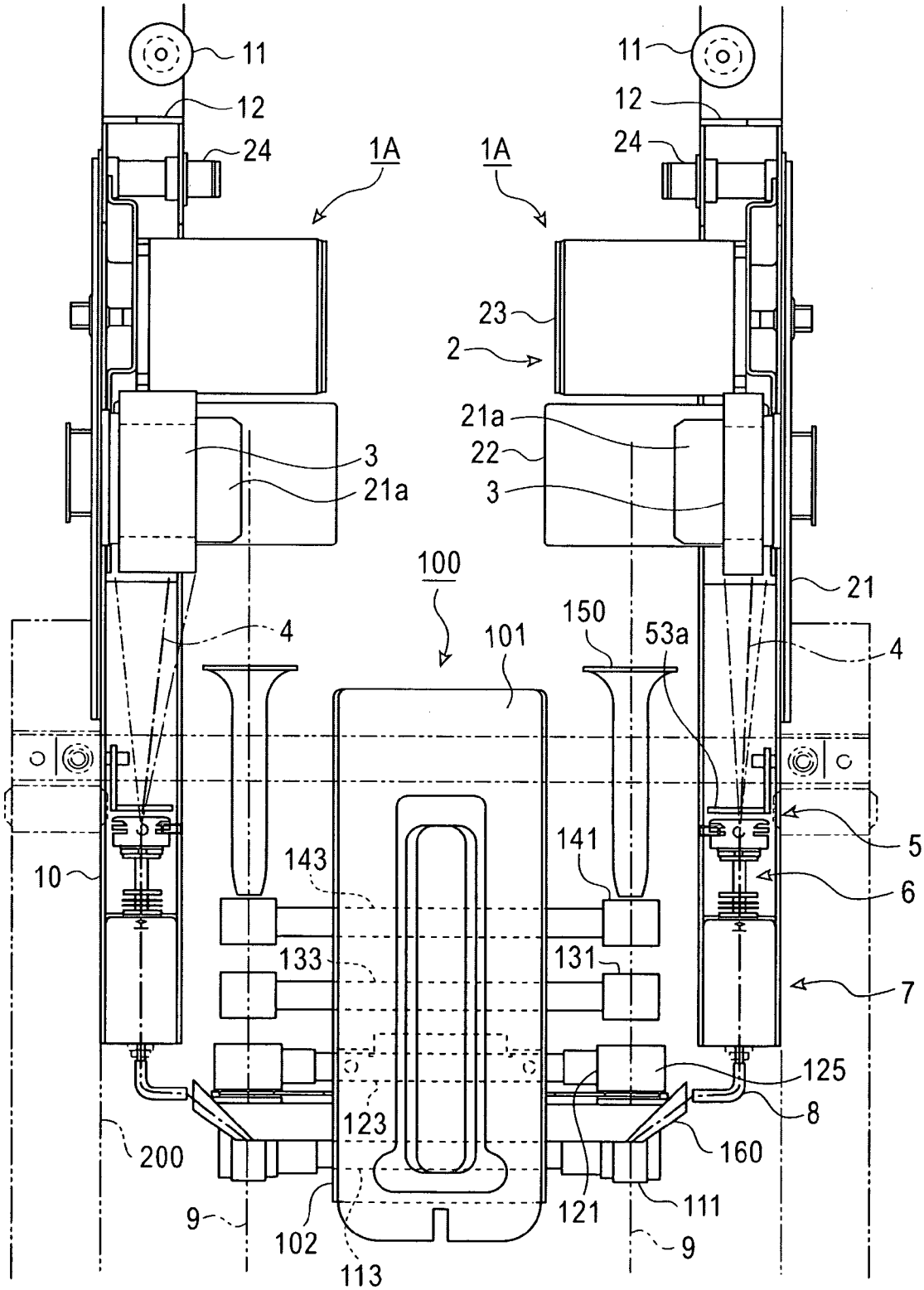
FIG. 5 is a plan view showing the core fiber supply device and a draft device.

FIGS. 1, 4, and 5 show that the core fiber supply device 1 is used as the CSY supply device 1A. The CSY feed-out device 2, yarn feeler 5, CSY air sucker 6, clamp cutter 7, and nozzle pipe 8 are attached to the base frame 10 of the core fiber supply device 1 along a path along which the elastic yarn 4 is fed out.

The lower left of FIG. 1 (and FIG. 2) corresponds to the front of machine frame of the core yarn manufacturing apparatus and is a reference for the core yarn manufacturing apparatus in its front-to-back direction (that is, the front). The front of the machine frame corresponds to a yarn path side along which a spun yarn runs. Inside the CSY supply device 1A, the CSY feed-out device 2, serving as a start position of the feed-out path of the elastic yarn 4, is placed in a rear upper part of the base frame 10. The nozzle pipe 8, serving as an end position of the feed-out path of the elastic yarn 4, is placed in a front part of the base frame 10. The feed-out path of the elastic yarn 4 is formed to extend from the rear upper part to front lower part of the base frame 10.

The CSY feed-out device 2 is a module which supports the CSY package 3 and which feeds the elastic yarn 4 out from the CSY package 3. The CSY package 3 is formed by winding the elastic yarn 4 around a bobbin. The CSY feed-out device 2 comprises a CSY cradle 21 that supports the CSY package 3, a CSY package driving drum 22 that contacts and rotates the CSY package 3 in synchronism with rotation of the CSY package driving drum 22, and a CSY package driving motor 23 serving as a driving source for the CSY package driving drum 22.

The CSY cradle 21 is an arm that is pivotable by a rotating support shaft 24 placed at a rear upper end of the base frame 10, and the CSY cradle 21 comprises a bobbin holder 21*a* that enables the bobbin of the CSY package 3 to be held and released. The CSY package driving drum 22 is placed in front of and below the rotating support shaft 24. Tilting the CSY cradle 21 forward brings the CSY package 3 supported by the CSY cradle 21 in contact with the CSY package driving drum 22. The CSY package driving motor 23 is placed between the rotating support shaft 24 and the CSY package driving drum 22.

In the CSY supply device 1A, the elastic yarn 4 drawn out from the CSY package 3 passes trough the CSY sucker 6 and clamp cutter 7 to the nozzle pipe 8. The elastic yarn 4 is supplied to the draft device 100 through the nozzle pipe 8 and then inserted into sheath fibers 9.

The nozzle pipe 8 is means for guiding the elastic yarn 4 supplied by the CSY supply device 1A, to an appropriate position (described below) in the draft device 100. The nozzle pipe 8 is also used for the CFY supply device 1B as previously described.

The clamp cutter 7 is a module that operates when the CSY supply device 1A stops the supply of the elastic yarn 4, to cut the elastic yarn 4 and hold the end of the cut elastic yarn 4. The clamp cutter 7 is also used for the CFY supply device 1B as previously described.

The CSY sucker 6 is a module that uses air injection to draw in the elastic yarn 4 drawn out from the CSY package 3 and that feeds out the drawn-in elastic yarn 4 to the nozzle pipe 8 via the clamp cutter 7. The CFY supply device 1B uses the CFY sucker 16 in place of the CSY sucker 6.

The yarn feeler 5 is placed on a feed-out path of the elastic yarn 4 extending from the CSY package 3 to the CSY sucker 6, and the yarn feeler 5 detects whether or not the elastic yarn 4 is present on the feed-out path. The yarn feeler 5 is also used for the CFY supply device 1B as previously described. The CFY supply device 1B detects whether or not the filament yarn 14 is present.

Figure 6:
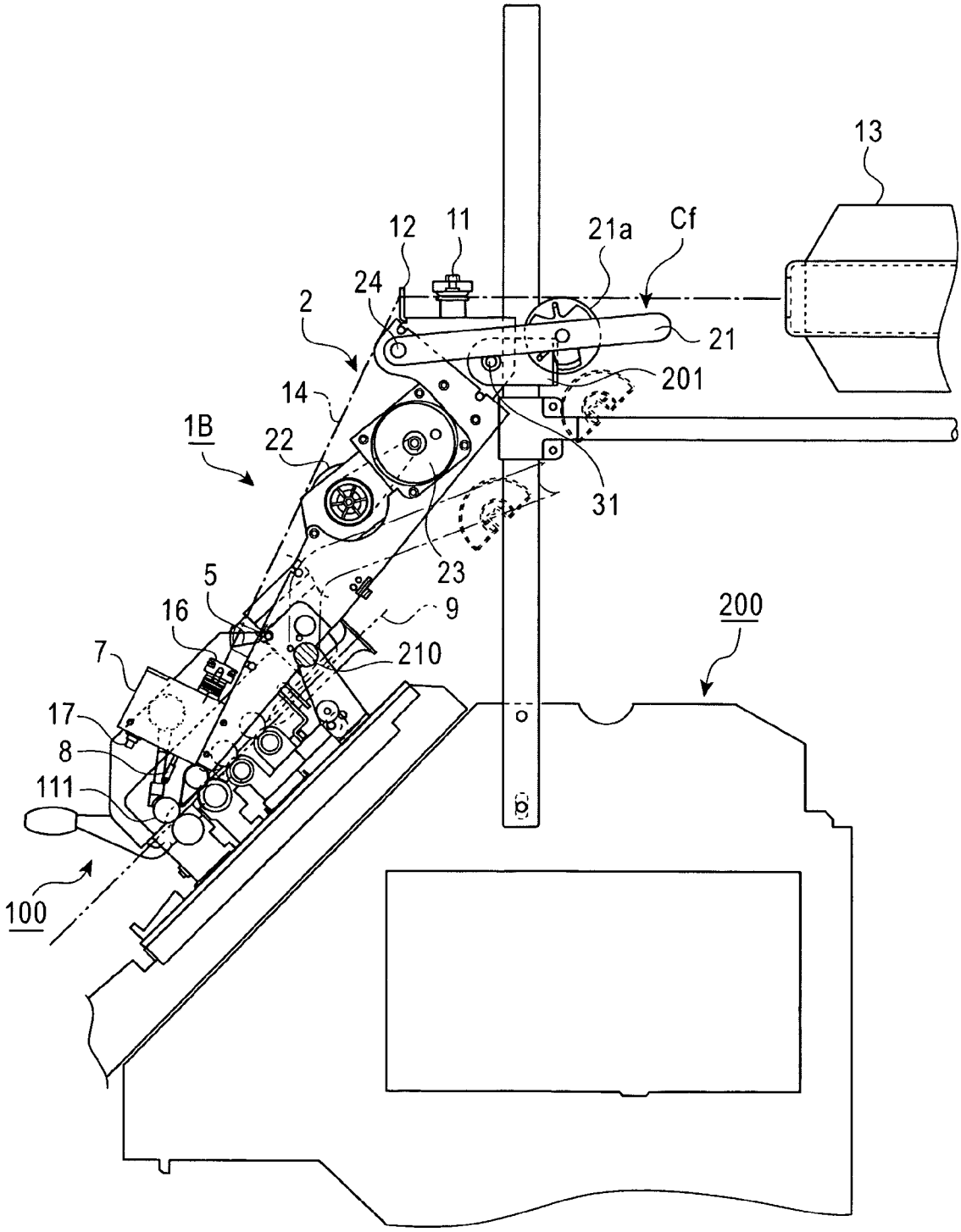
FIG. 6 is a perspective view showing that the core fiber supply device is used as a CFY supply device.

FIGS. 2 and 6 show that the core fiber supply device 1 is used as the CFY supply device 1B. The tenser 11, CFY yarn guide 12, yarn feeler 5, CFY air sucker 16, clamp cutter 7, and nozzle pipe 8 are attached to the base frame 10 of the core finer supply device 1 along the yarn path of the filament yarn 14. The CFY package 13 from which the filament yarn 14 is fed is placed behind the tenser 11. The CFY package 13 is formed by winding the filament yarn 14 around a bobbin.

Inside the CFY supply device 1B, the tenser 11 and yarn guide 12, serving as a start position of the feed-out path of the filament yarn 14, are placed in the rear upper part of the base frame 10, and the nozzle pipe 8, serving as an end position of the feed-out path of the filament yarn 14, is placed in the front part of the base frame 10. Like the feed-out path of the elastic yarn 4 in the CSY supply device 1A, the feed-out path of the filament yarn 14 is formed to extend from the rear upper part to front lower part of the base frame 10.

The CFY tenser 11 is a module that tenses the filament yarn 14 drawn out from the CFY package 13.

The CFY yarn guide 12 is means for guiding the feed-out path of the filament yarn 14 drawn out from the CFY package 13. The CFY yarn guide 12 bends the feed-out path of the filament yarn 14 as follows. The feed-out path of the filament yarn 14 is formed to extend directly forward on an upstream side of the CFY yarn guide 12 in the feed-out direction, and frontward and downward on a downstream side of the CFY yarn guide 12 in the feed-out direction.

Like the CSY sucker 6, the CFY sucker 16 uses air injection to draw in the filament yarn 14 drawn out from the CFY package 13 and that feeds out the drawn-in filament yarn 14 to the nozzle pipe 8 via the clamp cutter 7.

The clamp cutter 7 and nozzle pipe 8 are modules used not only for the CSY supply device 1A but also for the CFY supply device 1B. The clamp cutter 7 is a module which cuts the filament yarn 14 and which holds the end of the cut filament yarn 14. The nozzle pipe 8 is means for guiding the filament yarn 14 to an appropriate position (described below) in the draft device 100.

With reference to FIGS. 4, 5, and 6, a description will be given of the layout of the modules provided in the core fiber supply device 1. For the layout of the modules relating to the supply of core fibers, the CSY module layout is used for the elastic yarn 4, while the CFY module layout is used for the filament yarn 14. In either case, the feed-out path of the core fibers is inclined so that its front is lower than its rear with respect to the front of the machine frame.

As shown in FIGS. 4 and 5, the layout of the CSY modules is such that when the CSY supply device 1A is in operation, the feed-out path of the elastic yarn 4 is inclined so that its front is lower than its rear with respect to the front side of the machine frame. The CSY modules are arranged on the base frame 10 along the feed-out path of the elastic yarn 4; the CSY modules are composed of the CSY feed-out device 2, yarn feeler 5, CSY air sucker 6, clamp cutter 7, and nozzle pipe 8. The feed-out path of the elastic yarn 4 means the feed-out path of the elastic yarn 4 extending from the CSY package 3 supported by the CSY feed-out device 2 to the nozzle pipe 8, and does not mean the feed-out path located on a downstream side of the nozzle pipe 8.

When the CSY supply device 1A is in operation, the CSY cradle 21 supporting the CSY package 3 is kept inclining forward so as to allow the CSY feed-out device 2 to feed out the elastic yarn 4. The position of the CSY cradle 21 at this-time is defined as a cradle CSY position Cs. When the elastic yarn 4 is fed out, the CSY cradle 21 pivots in response to a variation in the diameter of the CSY package 3 (a decrease in the diameter caused by unwinding of the yarn). In other words, the cradle CSY position Cs is not a fixed point but the entire pivoting range.

As shown in FIG. 6, the layout of the CFY modules is such that when the CFY supply device 1B is in operation, the feed-out path of the filament yarn 14 is inclined so that its front is lower than its rear with respect to the front side of the machine frame. The CFY modules are arranged on the base frame 10 along the feed-out path of the filament yarn 14; the CFY modules are composed of the CFY tenser 11, CFY yarn guide 12, yarn feeler 5, CFY air sucker 16, clamp cutter 7, and nozzle pipe 8. On a downstream side of the CFY yarn guide 12, the feed-out path of the filament yarn 14 is inclined so that its front is lower than its rear. The feed-out path of the filament yarn 14 thus means the feed-out path of the filament yarn 14 extending from the CFY yarn guide 12 to the nozzle pipe 8, and does not mean the feed-out path located on an upstream side of the CFY yarn guide 12 or on a downstream side of the nozzle pipe 8.

Further, when the CFY supply device 1B is in operation, the CSY cradle 21 is kept inclining rearward so as to be prevented from interfering with the filament yarn 14, and the position of the CSY cradle 21 at this time is defined as a cradle CFY position Cf. When located at the cradle CFY position Cf, the CFY cradle 21 does not interfere with the feed-out path of the filament yarn 14 extending from the CFY package 13 to the CFY yarn guide 12 or with the feed-out path of the filament yarn 14 extending from the CFY yarn guide 12 to the nozzle pipe 8.

In a side view, the feed-out path of the elastic yarn 4 extending from the CSY feed-out device 2 to the nozzle pipe 8 substantially overlap the feed-out path of the filament yarn 14 extending from the CFY feed-out device 12 to the nozzle pipe 8. The CSY and CFY modules are laid out so that the feed-out paths of both yarns overlap.

Specifically, the contact portion between the CSY package 3 supported by the CSY cradle 21 and the CSY package driving drum 22 is located at the position where the feed-out path of the elastic yarn 4 extending from the CSY feed-out device 2 to the nozzle pipe 8 substantially overlap the feed-out path of the filament yarn 14 extending from the CFY feed-out device 12 to the nozzle pipe 8. The contact portion corresponds to a position where the elastic yarn 4 is unwound from the CSY package 3 and the start position of the feed-out path of the elastic yarn 4.

The clamp cutter 7 and nozzle pipe 8 are common both in the CSY modules and in the CFY modules. Consequently, laying out the CFY yarn guide 12 and CSY feed-out device 2 enables the feed-out path of the elastic yarn 4 to overlap the feed-out path of the filament yarn 14. Further, the following are also arranged on the feed-out paths of the elastic yarn 4 and filament yarn 14 so that the feed-out paths substantially overlap each other: the same yarn feeler 5 included both in the CSY modules and in the CFY modules and the CSY air sucker 6 and CFY air sucker 16 replaced with each other for the CSY supply device 1A and CFY supply device 1B.

As shown in FIGS. 4 and 6, the core fiber supply device 1 is placed above the draft device 100. The feed-out path of the sheath fibers 9 in the draft device 100 is inclined so that its front is lower than its rear with respect to the front side of the machine frame. However, the vertical inclination of feed-out path of the sheath fibers 9 is gentler than that of feed-out path of the core fibers in the core fiber supply device 1. Here, it is assumed that the feed-out path of the elastic yarn 4 in the CSY supply device 1A substantially overlaps the feed-out path of the filament yarn 14 in the CFY supply device 1B and that the type of the core fibers is not identified. Then, while moving from the rear to front of the apparatus, the core fibers fed out in the core fiber supply device 1 gradually approach the sheath fibers 9 conveyed by the draft device 100, and the core fibers are finally inserted into the sheath fibers 9. The nozzle pipe 8, serving as a core fiber outlet in the core fiber supply device 1, is located at a leading end of the core fiber supply device 1 and immediately above the front top roller 111 of the draft device 100.

A position switching mechanism of the core fiber supply device 1 will be described with reference to FIGS. 1, 2, 4, 5, and 6. In the core yarn manufacturing apparatus, the core fiber supply device 1 is placed at a peripheral position of the draft device 100. This may make the core fiber supply device 1 an obstacle to a maintenance operation on the draft device 100. A position switching mechanism is thus provided in the core fiber supply device 1 to enable the position of the core fiber supply device 1 relative to the draft device 100 to be switched between two levels. The position switching mechanism enables the base frame 10 to be locked at two positions within the range of rotation of the base frame 10; the base frame 10 is rotatably provided in a main frame 200 of the core yarn manufacturing apparatus.

As shown in FIG. 5, the core fiber supply device 1 is placed on each of the right and left sides of the draft device 100. This prevents the core fiber supply device 1 and the draft device 100 from overlapping in a plan view. The lateral direction of the core fiber supply device 1 is based on the front side of the machine frame and corresponds to the direction in which the large number of core fiber supply devices 1 and draft devices 100 are arranged in a line. As shown in FIGS. 1, 2, 4, and 6, in the vertical direction, the core fiber supply device 1 is mostly located above the draft device 100. In a side view, (lower) part of the core fiber supply device 1 overlaps the draft device 100.

Thus, both sides of the draft device 100 are enclosed by the core fiber supply device 1, resulting in difficulty in maintaining the draft device 100. The core fiber supply device 1 can be switched between two vertical positions so as to enable both sides of the draft device 100 to be opened. The vertical position of the core fiber supply device 1 can be switched between a position where the core fiber supply device 1 is located on a side of the draft device 100 during the supply of the core fibers and a position where the core fiber supply device 1 is upwardly withdrawn for maintenance.

Figure 7A:
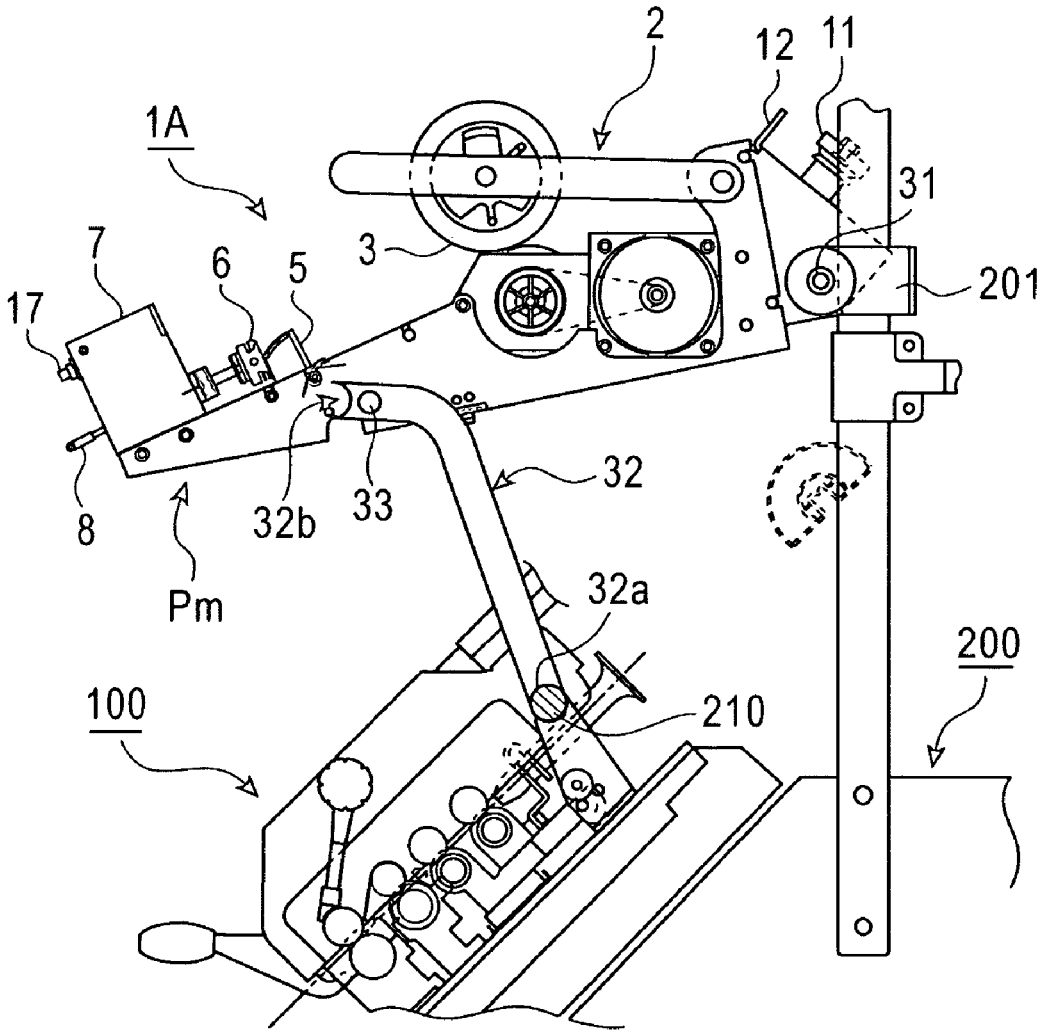
FIG. 7A shows a maintenance position and FIG. 7B shows a use position.
Figure 7B:
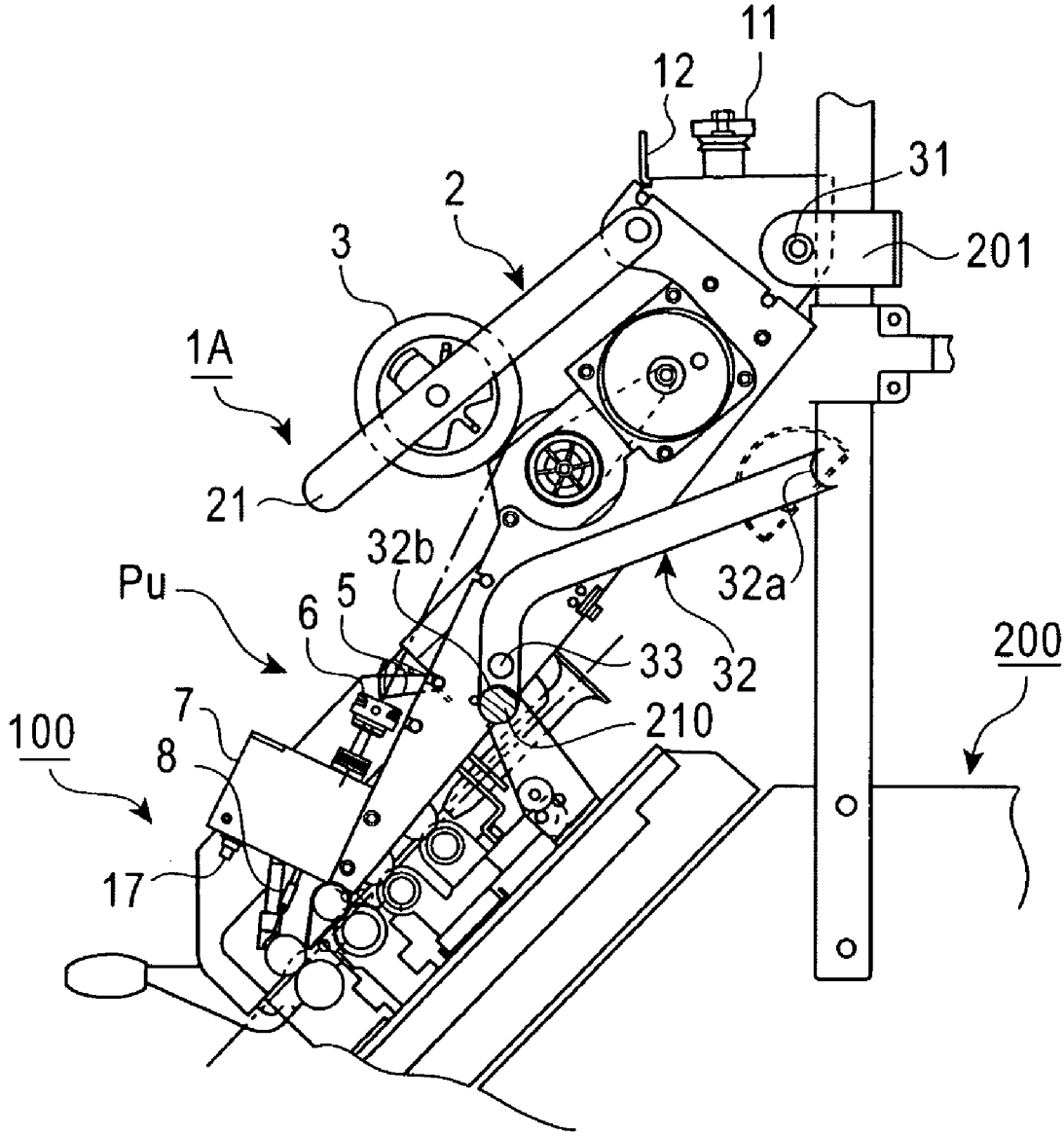

FIG. 7A shows the core fiber supply device 1 at a maintenance position Pm, and FIG. 7B shows the core fiber supply device 1 at a use position Pu. The core fiber supply device 1 can be switched between the maintenance position Pm and the use position Pu, and this position switching enables the core fiber supply device 1 to be moved in the vertical direction. The core fiber supply device 1 supplies the core fibers when located at the use position Pu with the nozzle pipe 8 approaching the draft device 100. To maintain the draft device 100, the core fiber supply device 1 is moved from the use position Pu to the maintenance position Pm, located above the use position Pu.

As shown in FIGS. 1 and 2, the base frame 10 is a hollow box-shaped frame and appears rectangular in a plan view and to be triangular in a side view. The base frame 10 is formed to be elongate along the feed-out path of the core fibers.

As shown in FIG. 7, attaching brackets 201 are fixedly provided on the main frame 200 for the respective core fiber supply devices 1. A rear end of the base frame 10 is attached to each attaching bracket 201 so as to be rotatable via a rotating support shaft 31. The rotating support shaft 31 serves as a support point for the position switching (position change) of the core fiber supply device 1.

A support arm 32 is provided in the middle of the base frame 10 in its front-to-back direction so as to be rotatable via an arm shaft 33. The main frame 200 has a support line shaft 210 extended along a direction in which the draft devices 100 (core fiber supply devices 1) are arranged in a line. The support arm 32 is provided with two engaging portions 32*a*, 32*b* that engage with the support line shaft 210. The rotatable core fiber supply device 1 is locked by engaging one of the engaging portions 32*a*, 32*b* with the support line shaft 210.

The support arm 32 is a plate-like member appearing V-shaped in a side view. One end of the support arm 32 is rotatably supported on the base frame 10 by the arm shaft 33. The engaging portions 32*a*, 32*b* are formed at the opposite ends of the support arm 32, and the engaging portions 32*a*, 32*b* are circular concave portions formed to an outer peripheral surface of the support line shaft 210. At the opposite ends of the support arm 32, the engaging portion 32*b* is formed on the end with the arm shaft 33, while the engaging portion 32*a* is formed on the end located opposite the arm shaft 33.

When the engaging portion 32*a* is engaged with the support line shaft 210 as shown in FIG. 7A, the core fiber supply device 1, urged downward by its own weight, is stopped from moving downward, and the core fiber supply device 1 is locked at the maintenance position Pm. Where the engaging portion 32*b* is engaged with the support line shaft 210 as shown in FIG. 7B, the core fiber supply device 1 is stopped from moving downward and locked at the use position Pu.

The layout of the nozzle pipe 8 and its peripheral part will be described with reference to FIG. 8. The nozzle pipe 8 serves as a core fiber ejection port in the core fiber supply device 1, and the clamp cutter 7 is provided on an upstream side of the nozzle pipe 8 along the feed-out path of the core fibers, and the air sucker is provided on a further upstream side of the nozzle pipe 8. The clamp cutter 7 is a module comprising both a cutter serving as means for cutting the core fibers and a clamp serving as means for gripping the cut core fibers. The air sucker is a module that uses air injection to draw in and feed out the core fibers, and the air sucker includes the CSY air sucker 6 used where the core fibers are the elastic yarn 4 and the CFY air sucker 16 used where the core fibers are the filament yarn 14.

During, for example, suspension of the manufacture of a core yarn, the clamp cutter 7 cuts the core fibers and grips the yarn end of the cut fibers. Where the manufacture of a core yarn is subsequently resumed, the core fibers gripped in the clamp cutter 7 are blown away by air injected by the air sucker, and the core fibers are thus fed out to the nozzle pipe 8. Accordingly, the feed-out path of the core fibers from the air sucker via the clamp cutter 7 to the nozzle pipe 8 is basically composed of an airtight path free from air leakage, and this allows the air sucker to effectively blow fibers.

Figure 8:
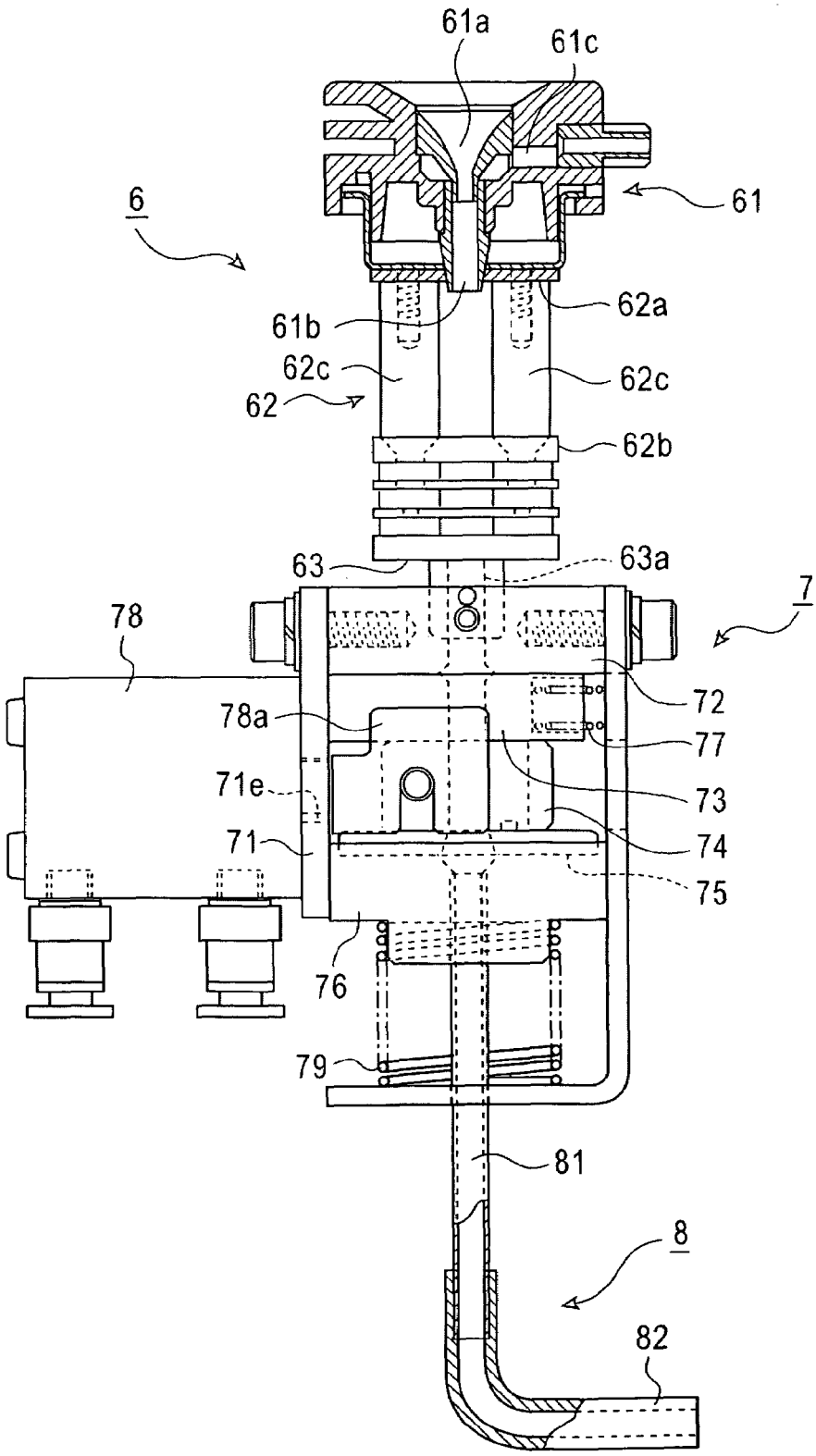
FIG. 8 is a partly sectional plan view showing the layout of a CSY air sucker, a clamp cutter, and a nozzle pipe.

FIG. 8 shows a configuration in which the CSY air sucker 6 is connected to the clamp cutter 7. The CSY air sucker 6 is composed of an air nozzle 61, a filter-less unit 62, a connecting guide 63, and a compressor (not shown in the drawings) serving as a source of air for the air nozzle 61.

The following paths are formed in the air nozzle 61: a guide-in path 61*a* into which the core fibers are guided, a guide-out path 61*b* out of which the core fibers are guided, and a suction path 61*c* through which air is sucked. The guide-in path 61*a* and the suction path 61*c* are separate from each other so as to be kept airtight but join into the guide-out path 61*b*. At the junction with the guide-out path 61*b*, the suction path 61*c* is placed outside the guide-in path 61*a*, and the guide-in path 61*a* and the suction path 61*c* are laid out so as to be concentric circle (ring). Accordingly, when the compressor ejects air through the suction path 61*c*, the air flows not only from the suction path 61*c* to guide-out path 61*b* but also from the guide-in path 61*a* to the guide-out path 61*b*. That is, the air outside the guide-in path 61*a* is thus sucked into the guide-in path 61*a*. With the above configuration, when the compressor is driven with the core fibers arranged near an inlet of the air nozzle 61 (guide-in path 61*a*), the core fibers are drawn into the guide-in path 61*a*, blown away toward the downstream side of the air nozzle 61, and thus fed out of the guide-out path 61*b*.

The connecting guide 63 is a spacer that connects the CSY air sucker 6 to the clamp cutter 7, and a passage hole 63*a* is formed inside the connecting guide 63 so that the core fibers can pass through the passage hole 63*a*. When the connecting guide 63 is attached to the clamp cutter 7, the passage hole 63*a* is connected to a core fiber guide-in path (inlet guide hole 72*a* described later) in the clamp cutter 7 so as to communicate with the core fiber guide-in path. The feed-out path of the core fibers from the connecting guide 63 to the clamp cutter 7 is airtight.

The filter-less unit 62 is a device that opens the feed-out path of the core fibers from the air nozzle 61 to the connecting guide 63 without keeping the feed-out path airtight. The filter-less unit 62 is composed of an attaching plate 62*a* attached to the air nozzle 61, an attaching portion 62*b* attached to the connecting guide 63, and a pair of connecting columns 62*c*, 62*c* that connect the attaching plate 62*a* and the attaching portion 62*b* together.

The core fibers fed out of the guide-out path 61*b* in the air nozzle 61 pass between the connecting columns 62*c*, 62*c* of the filter-less unit 62, and the core fibers are then fed to the passage hole 63*a* in the connecting guide 63. The passage path between the connecting columns 62*c*, 62*c* is open, thus allowing the air ejected from the guide-out path 61*b* to diffuse. This reduces the pressure of the air in the passage hole 63*a* significantly below that of air ejected from the guide-out path 61*b*.

The CSY sucker 6 is thus provided with the filter-less unit 62, which impairs the air-tightness, to reduce the pressure of air ejected to the clamp cutter 7 and nozzle pipe 8. The reason is as follows.

The elastic yarn 4 is a thin single yarn that is difficult to suck and catch. The CSY sucker 6 thus needs to perform a sucking operation for a long time. Since air ejected by the CSY sucker 6 is finally injected from the outlet (ejection port) of the nozzle pipe 8, a long sucking operation may affect the sheath fibers 9 being drafted by the draft device 100.

Thus, the CSY sucker 6 is thus provided with the filter-less unit 62, which impairs the air-tightness, to reduce the pressure of the air in the clamp cutter 7, while maintaining at least a given suction pressure at which the elastic yarn 4 is drawn into the CSY sucker 6. In particular, an increase in the length of the connecting columns 62*c*, 62*c*, constituting the filter-less unit 62, increases the amount of air diffused by the air nozzle 61 to reduce the ejection pressure. Therefore, appropriately designing or changing the length of the connecting columns 62*c*, 62*c* enables appropriate changes in the pressure of sir ejected from the nozzle pipe 8. The clamp cutter 7 and nozzle pipe 8 are kept airtight.

The above configuration reduces the pressure of air ejected from the nozzle pipe 8 even where the CSY sucker 6 injects air (suction or ejection) for a long time in order to catch the elastic yarn 4. This prevents the sheath fibers 9 in the draft device 100 from being affected.

Figure 9:
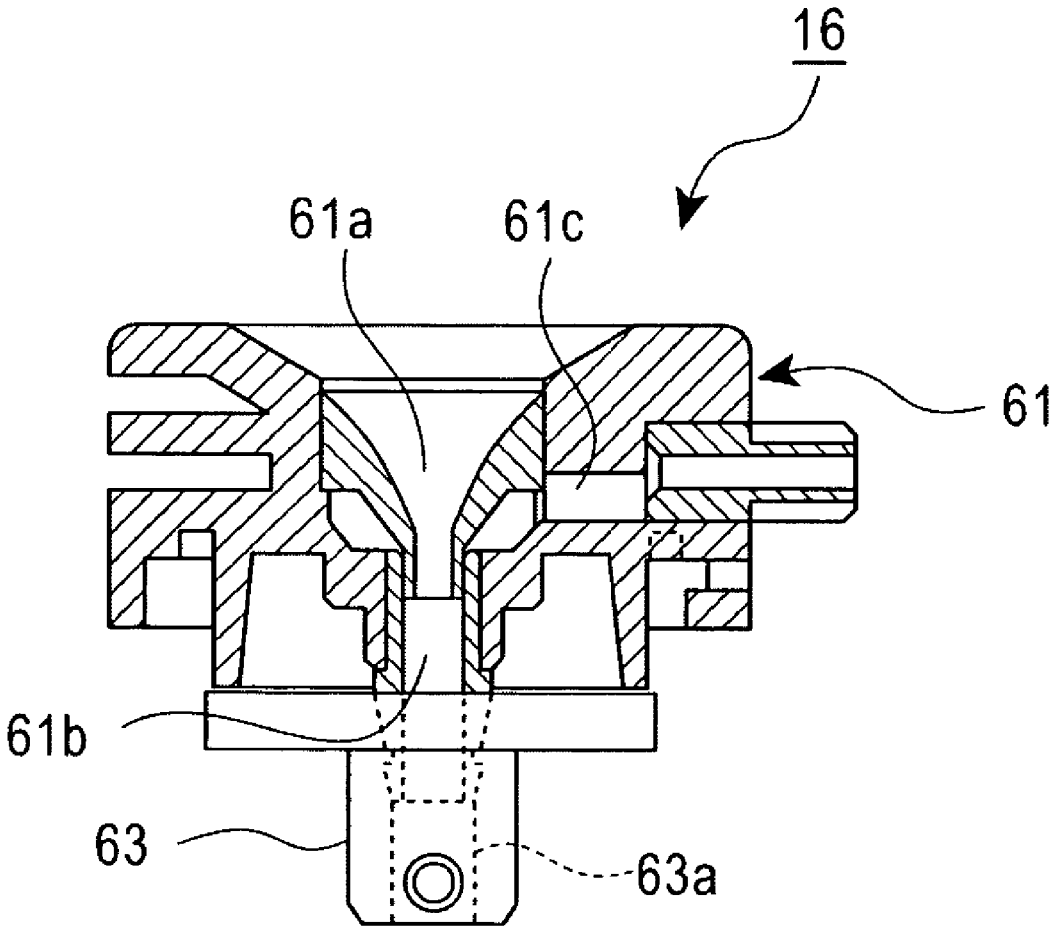
FIG. 9 is a partly sectional plan view showing the CFY air sucker.

On the other hand, the CFY air sucker 16, shown in FIG. 9, is composed of the air nozzle 61, the connecting guide 63, and the compressor (not shown in the drawings) serving as a source of air for the air nozzle 61, and the CFY air sucker 16 thus corresponds to the CSY air sucker 6 from which the filter-less unit 62 is removed and in which the air nozzle 61 and the connecting guide 63 are directly connected together. The direct connection between the air nozzle 61 and the connecting guide 63 allows the guide-out path 61*b* and the passage hole 63*a* to be connected together so as to communicate with each other while being kept airtight. Therefore, in the CFY air sucker 16, air ejected from the guide-out path 61*c* in the air nozzle 61 is supplied to the interior of the clamp cutter 7 without being diffused.

The filament yarn 14 is formed by bundling a plurality of filaments. The filament yarn 14 is thus easier to suck and catch, and is likely to get loose when subjected to air injection. The filter-less unit 62, which impairs the air-tightness, may cause the loose fibers (individual filaments) of the filament yarn 14 to be entangled with the connecting columns 62*c*, 62*c* owing to air ejected by the filter-less unit 62. Thus, CFY sucker 16 injects air (suction and ejection) for a short time to catch and feed the filament yarn 14, which is easier to catch, out to the nozzle pipe 8. The air injection is thus carried out for only a short time in spite of the high pressure, thus preventing the sheath fibers 9 in the draft device 100 from being affected by the air ejection.

Figure 10A:
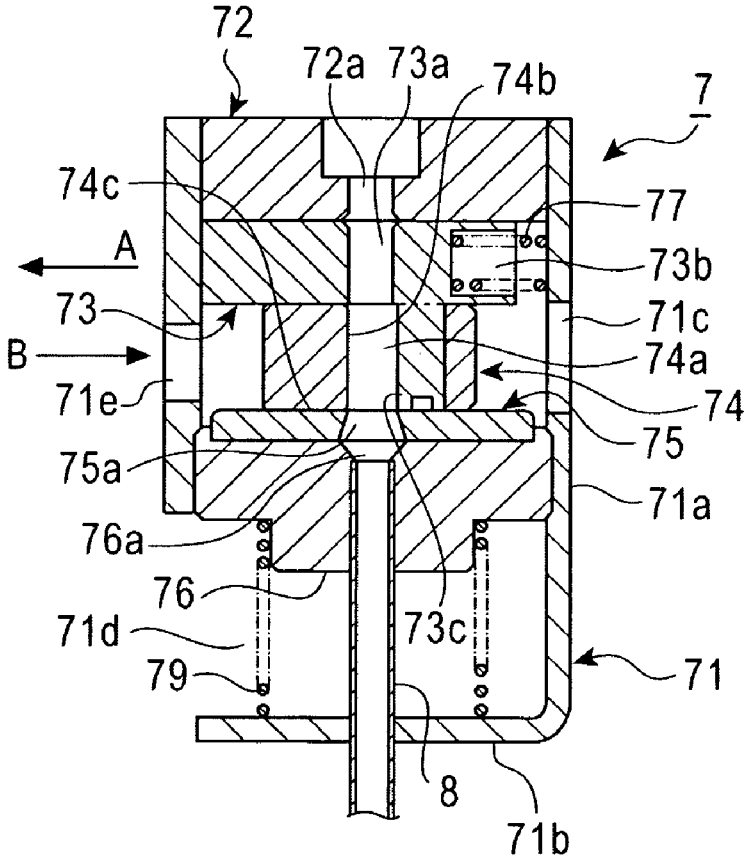
FIG. 10A is a sectional view taken along a plane extending in a direction in which core fibers are fed out and FIG. 10B is a sectional view taken along a plane crossing the core fiber feed-out direction.
Figure 10B:
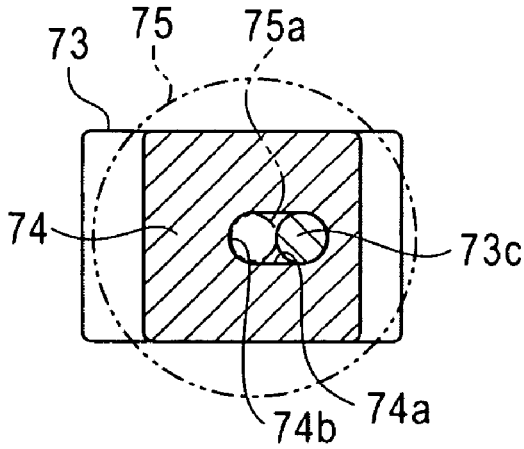

The clamp cutter 7 will be described with reference to FIGS. 8, 10, and 11. The clamp cutter 7 is a device comprising both a cutter serving as means for cutting the core fibers and a clamp serving as means for gripping the cut core fibers. In particular, the clamp cutter 7 is configured as described below so as to deal with the core fibers whether they are the elastic yarn 4 or the filament yarn 14.

Where the core fibers are the filament yarn, when the clamp's gripping timing is delayed with respect to the cutter's cutting timing, the filament yarn fed toward the downstream side may rub against the clamp. This may disadvantageously degrade yarn quality. Where the core fibers are the elastic yarn, the yarn itself has such a high elasticity that it is only elongated even if the cutter's cutting timing is delayed with respect to the clamp's gripping timing. This does not pose any serious problem. However, if the clamp's gripping timing is delayed with respect to the cutter's cutting timing, the elastic yarn itself is contacted by its elasticity and slips out of the inlet of the clamp cutter 7. The clamp cutter 7 is thus configured to reliably cut the yarn immediate after the clamp's gripping timing.

As shown in FIG. 10, the clamp cutter 7 comprises a support frame 71. The following path blocks are arranged inside the support frame 71 along the feed-out path of the core fibers: an inlet guide 72, a first moving member 73, a second moving member 74, a fixed blade 75, and an outlet guide 76. The nozzle pipe 8 is fixed to the outlet guide 76. The feed-out path is composed of an inlet guide hole 72*a* formed in the inlet guide 72, a first passage hole 73*a* formed in the first moving member 73, a second passage hole 74*a* formed in the second moving member 74, a cutter hole 75*a* formed in the fixed blade 75, an outlet guide hole 76*a* formed in the outlet guide 76, and an internal path in the nozzle pipe 8.

The support frame 71 is composed a cylinder 71*a* the axial direction of which is parallel to the feed-out path of the core fibers and a guide wall 71*b* that closes one of the openings in the cylinder 71*a*. The above path blocks are arranged inside the cylinder 71*a* along the axial direction (the above feed-out path). Besides the openings at the opposite ends, the cylinder 71*a* is provided, as required, with an opening 71*e* through which a piston arm 78*a* (described later) moving the first moving member 73 passes, an opening 71*c* that prevents interference with the moving second moving member 74, and an opening 71*d* in which the path blocks are assembled.

The inlet guide 72 is a columnar member which has a thickness along the feed-out path and is formed to the shape of inner wall of the cylinder 71*a*, and the inlet guide 72 is fitted into the inner wall of the cylinder 71*a*. An inlet guide hole 72*a* is formed in the center of the inlet guide 72 and constitutes a part of the feed-out path.

The first moving member 73 is a prism-like columnar member having a thickness along the feed-out path, and the first moving member 73 is supported inside the cylinder 71*a* so as to be movable in the lateral direction of FIG. 10, that is, the direction orthogonal to the feed-out path. In the feed-out direction, the first moving member 73 is sandwiched between the inlet guide 72 and the outlet guide 76, and supported so as to be immovable inside the support frame 71. A first passage hole 73*a* constituting a part of the feed-out path is formed in the center of the first moving member 73. The formed positions and opening sizes of the inlet guide hole 72*a* and first passage hole 73*a* are set so that the inlet guide hole 72*a* and the first passage hole 73*a* are in communication regardless of the position of the first moving member 73 in the above-described direction.

A spring hole 73*b* is formed in a sidewall (located opposite the inner wall of the cylinder 71*a*) of the first moving member 73, and a compression spring 77 is provided between the sidewall of the first moving member 73 and the inner wall of the cylinder 71*a* located opposite the sidewall. The direction A of urging force of the compression spring 77 corresponds to the leftward direction of FIG. 10, that is, one direction in the above-described direction.

A projecting portion 73*c* projecting toward the second moving member 74 is formed on the first moving member 73. The projecting portion 73*c* is shaped like a column the axial direction of which coincides with the feed-out direction. The projecting portion 73*c* is formed on a side of the first passage hole 73*a* which is closer to the compression spring 77 (right side of FIG. 10). In the above-described direction, the ends of the first passage hole 73*a* and projecting portion 73*c* are formed at positions where they almost contact each other. The projecting portion 73*c* is thus formed immediately adjacent to the first passage hole 73*a*. The projecting portion 73*c* is inserted into the second passage hole 74*a* in the second moving member 74.

Although described later in detail, the core fibers inserted into the clamp cutter 7 are sandwiched between and gripped by the projecting portion 73*c* and the second passage hole 74*a*. The projecting portion 73*c* and the second passage hole 74*a* correspond to one and the other of a pair of clamp pieces constituting the clamp.

The second moving member 74 is also a prism-like columnar member having a thickness along the feed-out path. The second moving member 74 is supported by the inner wall of the cylinder 71*a* so as to be movable in the lateral direction of FIG. 10, that is, the above-described direction, which is parallel to the first moving member 73. In the feed-out direction, the first moving member 73 is sandwiched between the inlet guide 72 and the outlet guide 76 and supported so as to be immovable inside the support frame 71. The second passage hole 74*a* is formed in the center of the second moving member 74; the second passage hole 74*a* constitutes a part of the feed-out path, and the projecting portion 73*c* can pass through the second passage hole 74*a*.

The second passage hole 74*a* is a slot having a diameter larger than that of the columnar projecting portion 73*c* along the above-described direction. Thus, the projecting portion 73*c* is movable along the above-described direction until it reaches either end of the second passage hole 74*a*. When the projecting portion 73*c* abuts against one of the opposite end surfaces of the second passage hole 74*a* which is located more backward in the urging direction A (as shown in FIG. 10), the first passage hole 73*a* and the second passage hole 74*a* are in communication. Thus, the feed-out path of the core fibers is not blocked but is open from the inlet guide hole 72*a* to the second passage hole 74*a*.

In the second moving member 74, the feed-out path of the core fibers is formed between the projecting portion 73*c* and the end surface of the second passage hole 74*a* which is located more forward in the urging direction A. The more forward end surface of the second passage hole 74*a* is defined as a clamp surface 74*b*. The clamp surface 74*b* is a curved surface that entirely contacts half of the outer peripheral surface of the projecting portion 73*c*. Thus, when the projecting portion 73*c* abuts against the more forward one (clamp surface 74*b*) of the opposite end surfaces of the second passage hole 74*a* (as shown in FIG. 11A1) described later), the feed-out path on an extension of the first passage hole 73*a* is closed. This corresponds to the gripping of the core fibers by the projecting portion 73*c* and clamp surface 74*b*.

As shown in FIG. 8, the clamp cutter 7 is provided with an air cylinder 78 serving as an actuator that moves the second moving member 74 forward and backward in the above-described direction. The second moving member 74 is fixed to a piston arm 78*a* provided in the air cylinder 78. The air cylinder 78 drivingly moves the second moving member 74 in the above-described direction to control its stationary position.

As shown in FIG. 10, the fixed blade 75 is a plate-like member that reduces the thickness of the feed-out path and is fixedly supported by the outlet guide 78. A cutter hole 75*a* is formed in the center of the fixed blade 75 so as to constitute a part of the feed-out path.

The cutter hole 75*a* has a diameter increasing along the feed-out path (the cutter hole 75*a* is tapered), and an upstream-side end surface of the fixed blade 75 in the feed-out direction is flattened. This results in the formation of a blade at the inlet (upstream-end) of the cutter hole 75*a*. On the other hand, a downstream-side end surface of the second moving member 74 in the feed-out direction is also flattened and defined as a movable blade surface 74*c*. The movable blade surface 74*c* is in slidable contact with the upstream-side end surface of the fixed blade 75. With this configuration, the movable blade surface 74*c* and the fixed blade 75, shaped by the cutter hole 75*a*, constitute a cutter serving as means cutting the core fibers. When the cutter hole 75*a* is closed by the movable blade surface 74*c*, the feed-out path of the core fibers is blocked. Where the core fibers are present in the feed-out path, they are cut.

The outlet guide 76 is a columnar member which has a thickness along the feed-out path and is formed to the shape of inner wall of the cylinder 71*a*, and the outlet guide 76 is inserted into the cylinder 71*a*. An outlet guide hole 76*a* is formed in the center of the outlet guide 76 and constitutes a part of the feed-out path. One end of the nozzle pipe 8 is inserted into the outlet guide hole 76*a*.

A guide wall 71*b* of the support frame 71 is located on a downstream side of the outlet guide 76 along the feed-out path. A cutter spring 79 is placed between the outlet guide 76 and the guide wall 71*b*, and the urging force of the cutter spring 79 presses the fixed blade 75 toward the second moving member 74 side. The cutter spring 79 thus urges the fixed blade 75 and movable blade 74*c* so as to reduce the spacing between the fixed blade 75 and the movable blade 74*c*. The urging force of the cutter spring 79 allows the path blocks, first moving member 73, and second moving member 74 to be supported in the support frame 71 without falling from it; the path blocks are arranged between the inlet guide 72 and the outlet guide 76.

An opening through which the nozzle pipe 8 is inserted is formed in the guide wall 71*b*.

Now, operational steps of the clamp cutter 7 will be described below with reference to FIGS. 10 and 11. FIGS. 10 and 11D show a step of halting the clamp cutter 7; the clamp cutter 7 is not used as a clamp or cutter for the core fibers but functions simply as the feed-out path of the core fibers. At this time, the feed-out path of the core fibers from the inlet guide 72 through the first moving member 73, second moving member 74, and fixed blade 75 to the outlet guide 76 is open without being blocked at any position.

Like FIG. 10A, FIGS. 11A1, 11B1, 11C1, and 11D1 are sectional views taken along a plane extending in the feed-out direction of the core fibers. Like FIG. 10B, FIGS. 11A2, 11B2, 11C2, and 11D2 are sectional views taken along a plane crossing the feed-out direction of the core fibers.

FIGS. 11A1 and 11A2 show the clamp cutter 7 in a pre-cut clamp step. The pre-cut clamp step means the operation of the clamp cutter 7 performed after the halting step shown in FIGS. 10, 11D1 and 11D2, and until the air cylinder 78 is driven to move the second moving member 74 in the direction (hereinafter referred to as a clamp direction B) opposite to the urging direction A so that the clamp surface 74*b* abuts against the projecting portion 73*c*. In this configuration, the movement of the second moving member 74 by the air cylinder 78 is not stopped by the abutment against the projecting portion 73*c*. Accordingly, the pre-cut clamp step is instantaneously executed. Where the core fibers (for example, the elastic yarn 4) are arranged in the feed-out path, during the pre-cut clamp step, the core fibers are gripped by the projecting portion 73*c* and clamp surface 74*b*, which constitute the clamp. During the pre-cut clamp step (FIGS. 11A1 and 11A2), when the clamp surface 74*b* abuts against the projecting portion 73*c*, the cutter hole 75*a* is not completely closed by the movable blade surface 74*c*. Thus, during the pre-cut clamp step, the core fibers are not cut but only gripped by the projecting portion 73*c* and clamp surface 74*b*.

FIGS. 11B1 and 11B2 show the clamp cutter 7 during a clamp cut step. The clamp cut step means the operation of the clamp cutter 7 performed after the pre-cut clamp step shown in FIGS. 11A1 and 11A2, and until the air cylinder 78 is further driven to move the second moving member 74 in the clamp direction B to abut the first moving member 73 against the inner wall of the cylinder 71*a*, the first moving member 73 moving in synchronism with the second moving member 74 having abutted against the first moving member 73. When the first moving member 73 abuts against the inner wall of the cylinder 71*a*, the cutter hole 75*a* is completely closed by the movable blade surface 74*c*.

During the clamp cut step, when the movable blade surface 74*c* completely closes the cutter hole 75*a*, the core fibers gripped by the projecting portion 73*c* and clamp surface 74*b* are cut by the movable blade surface 74*c* and the blade of the cutter hole 75*a*. This cutting causes parts of the core fibers which are located on a downstream side of the cut portion to slip out and fall from the clamp cutter 7. However, the yarn end of the core fibers located on an upstream side of the cut portion remains gripped by the projecting portion 73*c* and the clamp surface 74*b* and thus held in the clamp cutter 7.

The second moving member 74 (second insertion hole 74*b*) abuts against the first moving member 73 (projecting portion 73*c*) during the pre-cut clamp step. Thus, further moving the second moving member 74 in the clamp direction B causes the first moving member 73 to be pressed by and moved in synchronism with the second moving member 74. The pressing force exerted on the second moving member 74 by the air cylinder 78 (force moving the second moving member 74) is stronger than the urging force of the compression spring 77. The air cylinder 78 can thus push the second moving member 74 in the clamp direction B against the urging force of the compression spring 77. The core fibers gripped by the projecting portion 73*c* and clamp surface 74*b* are reliably sandwiched between them by the urging force of the compression spring 77, acting on the projecting portion 73*c*.

To allow the clamp cutter 7 to continue clamping the core fibers, the air cylinder 78 is controllably driven so as to maintain the condition of the clamp cutter 7 observed at the end of the clamp cut step (FIGS. 11B1 and 11B2). The following condition is thus maintained: the air cylinder 78 is continuously driven to press the second moving member 74 in the clamp direction B against the urging force of the compression spring 77 to abut the first moving member 73 against the inner wall of the cylinder 71*a*. As long as the clamp cutter 7 is in this condition, the urging force exerted on the projecting portion 73*c* by the compression spring 77 allows the core fibers to be reliably gripped between the projecting portion 73*c* and the clamp surface 74*b*.

FIGS. 11C1 and 11C2 show the clamp cutter 7 during a post-cut clamp step. The post-cut clamp step means the operation of the clamp cutter 7 performed after the clamp cut step shown in FIGS. 11B1 and 11B2, and until the air cylinder 78 is driven to move the second moving member 74 in the urging direction A to a position where the clamp surface 74*b* is separated from the projecting portion 73*c*. The condition of the clamp cutter 7 at the end of the post-cut clamp step is the same as that of the clamp cutter 7 at the end of the pre-cut clamp step, shown in FIGS. 11A1 and 11A2, except for the driving direction of the air cylinder 78. In this configuration, the movement of the second moving member 74 by the air cylinder 78 is not stopped by the separation of the second moving member 74 from the projecting portion 73*c*. Accordingly, the per-cut clamp step is instantaneously executed.

When the air cylinder 78 is driven to move the second moving member 74 further in the urging direction A from the condition observed during the post-cut clamp step, shown in FIGS. 11C1 and 11C2, the clamp cutter 7 returns to its condition observed during the halting step, shown in FIGS. 11D1 and 11D2 or 10.

After the end of the post-cut clamp step, the holding of the core fibers by the clamp cutter 7 is canceled. At this time, by using the CSY air sucker 6 or CFY air sucker 16 to feed air along the feed-out path in the clamp cutter 7, it is possible to feed the core fibers out of the clamp cutter 7 and then through the nozzle pipe 8.

The feed-out path of the core fibers in the clamp cutter 7 is constructed by connecting the holes (first insertion hole 73*a*, second insertion hole 74*a*, and others) formed in the path blocks (inlet guide 72, first moving member 73, and others) together. The holes formed in the path blocks (inlet guide hole 72*a*, first insertion hole 73*a*, second insertion hole 74*a*, cutter hole 75*a*, and outlet guide hole 76*a*) have circular cross sections of almost the same inner diameter. The second insertion hole 74*a* is a slot and has a latitudinal width almost equal to the diameter of the holes 72*a*, 73*a*, 74*a*, 75*a*, 76*a* except the second insertion hole 74*a*, and since the projecting portion 73*c* stays inside the second insertion hole 74*a*, the substantial opening size of the second insertion hole 74*a* is similar to that of the other holes 72*a*, 73*a*, 74*a*, 75*a*, 76*a*. Further, in the core fiber feed-out direction, the path blocks are urged by the cutter spring 79 so as to be pressed against one another. The path blocks are thus kept airtight.

In the above configuration, the feed-out path of the core fibers formed in the clamp cutter 7 is kept airtight so as to prevent the escape of air. This enables the core fibers to be reliably blown (fed out) by air injected by the CSY air sucker 6 or CFY air sucker 16.

A clamp cutter 107 in accordance with a second embodiment will be described with reference to FIGS. 12 and 13. The clamp cutter 107 is similar to the clamp cutter 7 (first embodiment) and comprises both a cutter serving as means for cutting the core fibers and a clamp serving as means for gripping the cut core fibers. In the core fiber supply device 1, the clamp cutter 7 (first embodiment) is replaced with the clamp cutter 107 (second embodiment). In this case, the CSY air sucker 6 (or CFY air sucker 16) and nozzle pipe 8 are connected to the clamp cutter 107.

Figure 12:
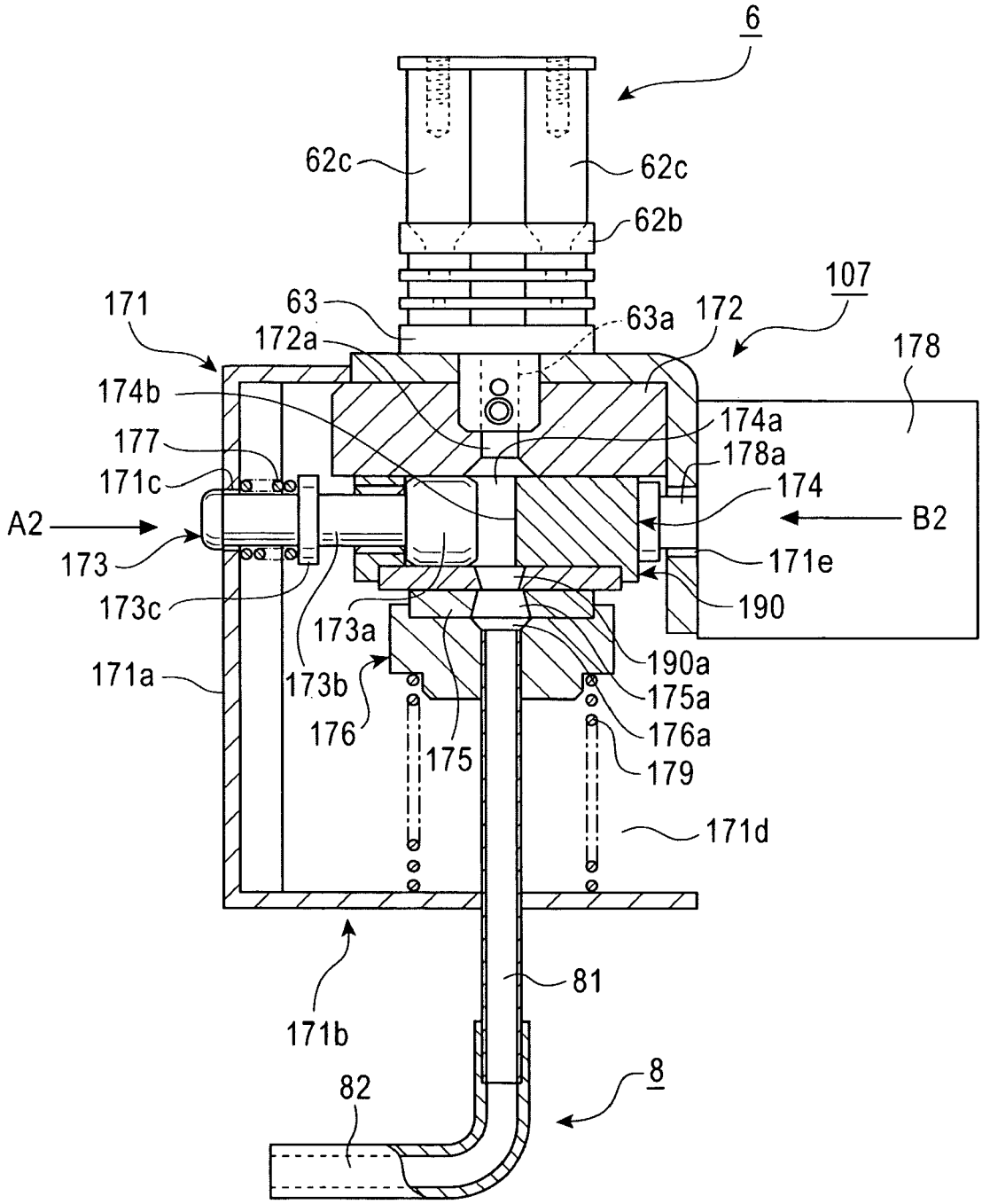
FIG. 12 is a partly sectional plan view showing the layout of the CSY air sucker, a clamp cutter in accordance with a second embodiment, and the nozzle pipe.

As shown in FIG. 12, the clamp cutter 107 comprises a support frame 171, and the following path blocks are arranged inside the support frame 171 along a feed-out path of the core fibers: an inlet guide 172, a first moving member 173, a second moving member 174, a movable blade 190, a fixed blade 175, and an outlet guide 176. The movable blade 190 is fixed to the second moving member 174. The nozzle pipe 8 is fixed to the outlet guide 176. The feed-out path is composed of an inlet guide hole 172*a* formed in the inlet guide 172, a gap formed between the first moving member 173 and the second moving member 174, a cutter hold 190*a* formed in the movable blade 190, a cutter hole 175*a* formed in the fixed blade 175, an outlet guide hole 176*a* formed in the outlet guide 176, and an internal path in the nozzle pipe 8.

The support frame 171 is composed a cylinder 171*a* the axial direction of which is parallel to the feed-out path of the core fibers and a guide wall 171*b* that closes one of the openings in the cylinder 171*a*. The above path blocks are arranged inside the cylinder 171*a* along the axial direction (the feed-out path). Besides the openings at the opposite ends, the cylinder 171*a* is provided, as required, with an opening 171*e* through which a piston rod 178*a* (described later) moving the first moving member 173 passes, an opening 171*c* that prevents interference with the moving operating clam piece 174, and an opening 171*d* in which the path blocks are assembled.

The inlet guide 172 is a columnar member which has a thickness along the feed-out path and is formed to the shape of inner wall of the cylinder 171*a*, and the inlet guide 172 is fitted into the inner wall of the cylinder 171*a*. An inlet guide hole 172*a* is formed in the center of the inlet guide 172 and constitutes a part of the feed-out path.

The first moving member 173 is composed of a columnar follower clamp piece 173*a*, a pin 173*b* extending from the follower clamp piece 173, and a spring receiver 173*c* externally fitted around the middle of the pin 173*b*. The first moving member 173 is sandwiched between the inlet guide 172 and the outlet guide 176, and is thus immovable in the feed-out direction. Instead, the first moving member 173 is movable in the lateral direction of FIG. 10, that is, the direction orthogonal to the feed-out direction. The first moving member 173 is placed so that the extending direction of the pin 173*b* is parallel to the above-described direction. Then, the follower clamp piece 173*a* is located opposite the feed-out path, and an outer end of the pin 173*b* (end not provided with the follower clamp piece 173*a*) projects out of the cylinder 171*a* through the opening 171*c*.

A compression spring 177 is placed between the spring receiver 173*c* and an inner wall surface of the cylinder 171*a* located opposite the spring receiver 173*c*. The urging direction A2 of the compression spring 177 acts in the rightward direction of FIG. 10, that is, one direction in the above-described direction. In this configuration, wherever the first moving member 173 is located in the above-described direction, the inlet guide hole 172*a* is not blocked by the flower clamp piece 173*a*. Only the second moving member 174 can block the inlet guide hole 172*a*.

The second moving-member 174 is also a prism-like columnar member having a thickness along the feed-out path. The second moving member 174 is supported inside the cylinder 171*a* so as to be movable in the lateral direction of FIG. 12, that is, the direction orthogonal to the feed-out path. In the feed-out direction, the second moving member 174 is sandwiched between the inlet guide 172 and the outlet guide 176, and supported so as to be immovable inside the support frame 171. A second passage hole 174*a* is formed in the center of the second moving member 174; the second passage hole 174*a* enables the first moving member 173 to move in the above-described direction (lateral direction of FIG. 12) with respect to the second moving member 174.

The second passage hole 174*a* is composed of a slot portion having a diameter larger than that of the columnar follower clamp piece 173*a* in the above-described direction, and an insertion hole portion through which the pin 173*b* is inserted. The follower clamp piece 173*a* is thus movable in the above-described direction until it abuts against either end of the second passage hole 174*a*. When the follower clamp piece 173*a* abuts against one of the opposite end surfaces of the second passage hole 174*a* which is located more forward in an urging direction A2 (as shown in FIG. 10), the second passage hole 174*a* is not closed by the follower clamp piece 173*a* and is open. Thus, the feed-out path of the core fibers is not blocked but is open from the inlet guide hole 172*a* to the second passage hole 174*a*.

Figure 13A:
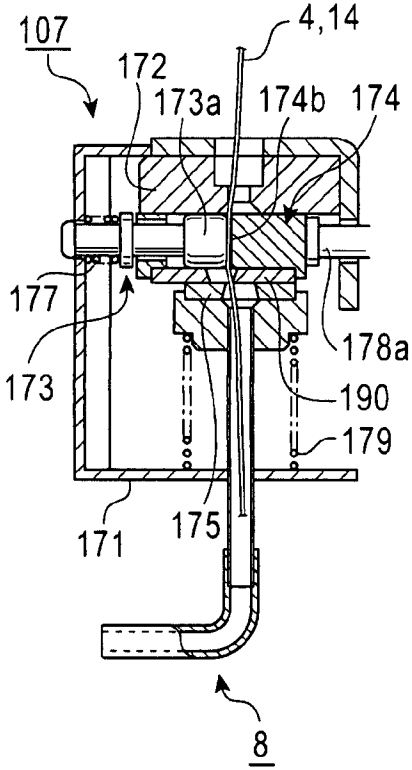
FIG. 13A shows a halting step.

In the second moving member 174, the feed-out path of the core fibers is formed between the follower clamp piece 173*a* and the end surface of the second passage hole 174*a* which is located more backward in the urging direction A2. The more backward end surface of the second passage hole 174*a* is defined as a clamp surface 174*b*. The clamp surface 174*b* is a curved surface that entirely contacts half of the outer peripheral surface of the follower clamp piece 173*a*. Thus, when the follower clamp piece 173*a* abuts against the one (clamp surface 174*b*) of the opposite end surfaces of the second passage hole 174*a* which is located more backward in the urging direction A2 (as shown in FIG. 13A described later), the feed-out path on an extension of the inlet guide hole 172*a* is closed. This corresponds to the gripping of the core fibers by the follower clamp piece 173*a* and clamp surface 174*b*.

As shown in FIG. 12, the clamp cutter 107 is provided with an air cylinder 178 serving as an actuator that moves the second moving member 174 forward and backward in the above-described direction. The second moving member 174 is fixed to a piston rod 178*a* provided in the air cylinder 178. The air cylinder 178 drivingly moves the second moving member 174 in the above-described direction to control its stationary position.

As shown in FIG. 12, the fixed blade 175 is a plate-like member that reduces the thickness of the feed-out path and is fixedly supported by the outlet guide 178. A cutter hole 175*a* is formed in the center of the fixed blade 175 so as to constitute a part of the feed-out path. The cutter hole 175*a* has a diameter increasing along the feed-out path (the cutter hole 175*a* is tapered). An upstream-side end surface of the fixed blade 175 in the feed-out direction is flattened. This results in the formation of a blade at the inlet (upstream-side end) of the cutter hole 175*a*.

On the other hand, the movable blade 190 is fixed to a downstream side of the second moving member 174 in the feed-out direction. A cutter hole 190*a* is formed in the movable blade 190; the cutter hole 190 is in communication with the second insertion hole 174*a* and constitutes a part of the feed-out path. A downstream-side end surface of the movable blade 190 in the feed-out direction is flattened, and a blade is formed at an outlet (downstream-side end) of the cutter hole 190*a*. A downstream-side end surface of the movable blade 190 is in slidable contact with the upstream-side end surface of the fixed blade 175. With this configuration, the movable blade 190 and the fixed blade 175 constitute a cutter serving as means cutting the core fibers. When the movable blade 190 (second moving member 174) moves with respect to the fixed blade 175 to close the cutter hole 190*a* and the cutter hole 175*a*, the feed-out path of the core fibers is blocked. If the core fibers are present in the feed-out path, they are cut.

The outlet guide 176 is a columnar member which has a thickness along the feed-out path and is formed to the shape of inner wall of the cylinder 171*a*, and the outlet guide 176 is inserted into the cylinder 171*a*. An outlet guide hole 176*a* is formed in the center of the outlet guide 176 and constitutes a part of the feed-out path. One end of the nozzle pipe 8 is inserted into the outlet guide hole 176*a*.

A guide wall 171*b* of the support frame 171 is located on a downstream side of the outlet guide 176 along the feed-out path. A cutter spring 179 is placed between the outlet guide 176 and the guide wall 171*b*. The urging force of the cutter spring 179 presses the fixed blade 175 toward the movable blade 190 side. The cutter spring 179 thus urges the fixed blade 175 and movable blade 190 so as to reduce the spacing between the fixed blade 175 and the movable blade 190. The urging force of the cutter spring 179 allows the path blocks, first moving member 173, and second moving member 174 to be supported in the support frame 171 without falling from it; the path blocks are arranged between the inlet guide 172 and the outlet guide 176.

An opening through which the nozzle pipe 8 is inserted is formed in the guide wall 171*b*.

Now, operational steps of the clamp cutter 107 will be described below with reference to FIGS. 12 and 13. The operational steps of the clamp cutter 107 are similar to those of the clamp cutter 7, described with reference to FIGS. 10 and 11. FIGS. 12 and 13D show a step of halting the clamp cutter 107; the clamp cutter 107 is not used as a clamp or cutter for the core fibers but functions simply as the feed-out path of the core fibers. At this time, the feed-out path of the core fibers from the inlet guide 172 through the gap between the first moving member 173 and second moving member 174, the movable blade 190, and the fixed blade 175 to the outlet guide 176 is open without being blocked at any position.

FIG. 13A shows the clamp cutter 107 in a pre-cut clamp step. The pre-cut clamp step means the operation of the clamp cutter 107 performed after the halting step shown in FIGS. 12 and 13D, and until the air cylinder 178 is driven to move the second moving member 174 in the direction (hereinafter referred to as a clamp direction B2) opposite to the urging direction A2 so that the clamp surface 174*b* abuts against the follower clamp piece 173*a*. In this configuration, the movement of the second moving member 174 by the air cylinder 178 is not stopped by the abutment against the follower clamp piece 173*a*. Accordingly, the pre-cut clamp step is instantaneously executed. Where the core fibers (for example, the elastic yarn 4) are arranged in the feed-out path, then during the pre-cut clamp step, the core fibers are gripped by the follower clamp piece 173*a* and clamp surface 174*b*, which constitute the clamp. During the pre-cut clamp step, the abutment of the clamp surface 174*b* against the follower clamp piece 173*a* does not completely close the cutter holes 190*a*, 175*a*. Thus, during the pre-cut clamp step, the core fibers are not cut but only gripped by the follower clamp piece 173*a* and clamp surface 174*b*.

Figure 13B:
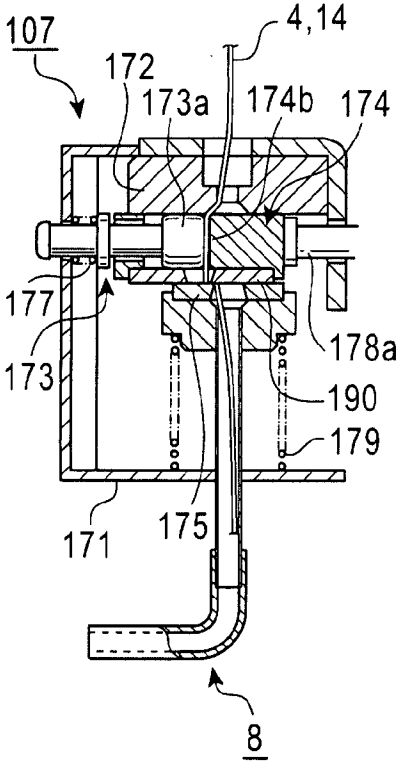
FIG. 13B shows a pre-cut clamp step.

FIG. 13B shows the clamp cutter 107 during a clamp cut step. The clamp cut step means the operation of the clamp cutter 107 performed after the pre-cut clamp step shown in FIG. 13A and until the air cylinder 178 is further driven to move the second moving member 174 in the clamp direction B2 to push the first moving member 173 away from the air cylinder 178 by a given distance, the first moving member 173 moving in synchronism with the second moving member 174 having abutted against the first moving member 173.

During the clamp cut step, the first moving member 173 is pushed away from the air cylinder 178 by the given distance, when the cutter holes 190*a*, 175*a* are completely closed. This causes the core fibers gripped by the follower clamp piece 173*a* and clamp surface 174*b* to be cut by the movable blade 190 and the fixed blade 175. This cutting causes parts of the core fibers which are located on a downstream side of the cut portion to slip out and fall from the clamp cutter 107. However, the yarn end of the core fibers located on an upstream side of the cut portion remains gripped by the follower clamp piece 173*a* and the clamp surface 174*b*, and thus held in the clamp cutter 107.

The second moving member 174 (clamp surface 174*b*) abuts against the first moving member 173 (follower clamp piece 173*a*) during the pre-cut clamp step. Thus, further moving the second moving member 174 in the clamp direction B2 causes the first moving member 173 to be pressed by and moved in synchronism with the second moving member 174. The pressing force exerted on the second moving member 174 by the air cylinder 178 (force moving the second moving member 174) is stronger than the urging force of the compression spring 177. The air cylinder 178 can thus push the second moving member 174 in the clamp direction B2 against the urging force of the compression spring 177. The core fibers gripped by the follower clamp piece 173*a* and clamp surface 174*b* are reliably sandwiched between them by the urging force of the compression spring 177, acting on the follower clamp piece 173*a*.

To allow the clamp cutter 107 to continue clamping the core fibers, the air cylinder 178 is controllably driven so as to maintain the condition of the clamp cutter 107 observed at the end of the clamp cut step (FIG. 13B). That is, the following condition is thus maintained: the air cylinder 178 is continuously driven to press the second moving member 174 in the clamp direction B2 against the urging force of the compression spring 177 to abut the follower clamp piece 173*a* against the clamp surface 174*b*. As long as the clamp cutter 107 is in this condition, the urging force exerted on the follower clamp piece 173*a* by the compression spring 177 allows the core fibers to be reliably gripped between the follower clamp piece 173*a* and the clamp surface 174*b*.

Figure 13C:
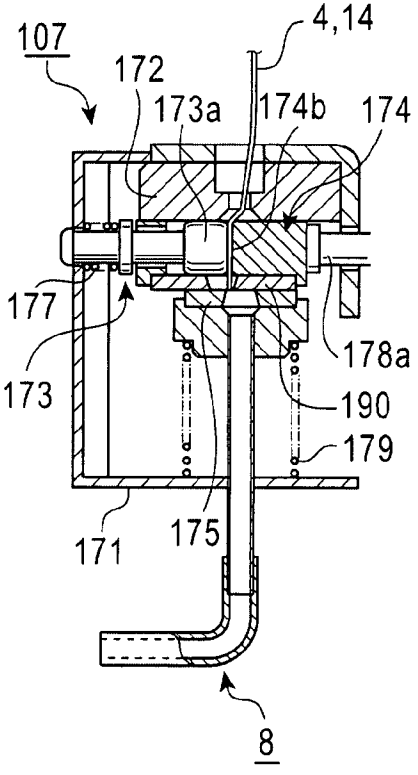
FIG. 13C shows a clamp cut step.
Figure 13D:
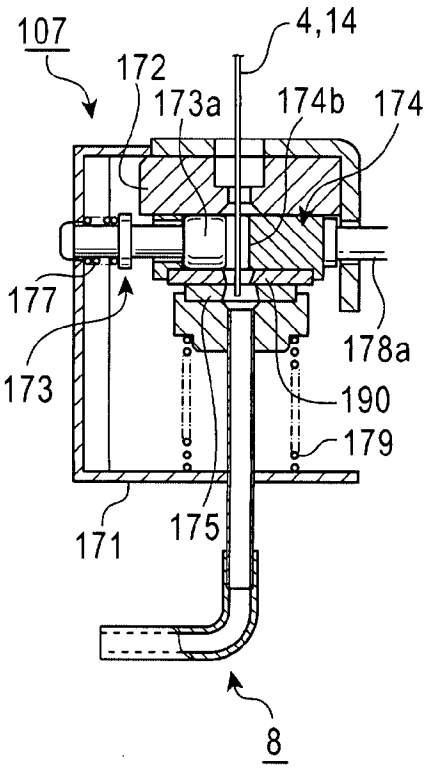
FIG. 13D shows a post-cut clamp step.

FIG. 13C shows the clamp cutter 107 during a post-cut clamp step. The post-cut clamp step means the operation of the clamp cutter 107 performed after the clamp cut step shown in FIG. 13B and until the air cylinder 178 is driven to move the second moving member 174 in the urging direction A2 to a position where the clamp surface 174*b* is separated from the follower clamp piece 173*a*. The condition of the clamp cutter 107 at the end of the post-cut clamp step is the same as that of the clamp cutter 107 at the end of the pre-cut clamp step, shown in FIG. 13A, except for the driving direction of the air cylinder 178. In this configuration, the movement of the second moving member 174 by the air cylinder 178 is not stopped by the separation of the second moving member 174 from the follower clamp piece 173*a*. Accordingly, the per-cut clamp step is instantaneously executed.

When the air cylinder 178 is driven to move the second moving member 174 further in the urging direction A2 from the condition observed during the post-cut clamp step, shown in FIG. 13C, the clamp cutter 107 returns to its condition observed during the halting step, shown in FIG. 13D or 12.

After the end of the post-cut clamp step, the holding of the core fibers by the clamp cutter 107 is canceled. At this time, by using the CSY air sucker 6 or CFY air sucker 16 to feed air along the feed-out path in the clamp cutter 107, it is possible to feed the core fibers out of the clamp cutter 107 and then through the nozzle pipe 8.

The feed-out path of the core fibers in the clamp cutter 107 is constructed by connecting the holes formed in the path blocks (inlet guide 172, outlet block 176, and others) and the gap between the first moving member 173 and the second moving member 174 (gap between the second insertion hole 174*a* and the follower clamp piece 173*a*). The holes formed in the path blocks (inlet guide hole 172*a*, cutter holes 175*a*, 190*a*, and outlet guide hole 176*a*) have circular cross sections of almost the same inner diameter. The second insertion hole 174*a* is a slot and has a latitudinal width almost equal to the diameter of the holes 172*a*, 175*a*, 190*a*, 176*a* except the second insertion hole 174*a*. Since the follower clamp piece 173*a* is always inserted inside the second insertion hole 174*a*, the substantial opening size of the second insertion hole 174*a* is similar to that of the other holes 172*a*, 175*a*, 190*a*, 176*a*. Further, in the core fiber feed-out direction, the path blocks are urged by the cutter spring 179 so as to be pressed against one another. The path blocks are thus kept airtight.

In the above configuration, the feed-out path of the core fibers formed in the clamp cutter 107 is kept airtight so as to prevent the escape of air. This enables the core fibers to be reliably blown (fed out) by air injected by the CSY air sucker 6 or CFY air sucker 16.

The nozzle pipe 8 will be described with reference to FIG. 8. The nozzle pipe 8 is composed of a linear pipe 81 fixed to the outlet guide 76 and a bent pipe 82 fitted into the linear pipe 81. The linear pipe 81 is shaped like a straight line, and the bent pipe 82 is bent at a right angle in its middle. Both pipes 81, 82 are cylindrical members in which a path of the core fibers is formed.

The linear pipe 81 is a rigid member made of metal or the like. The bent pipe 82 is made of a wear-resistant material such as ceramics. Fitting one end of the bent pipe 82 around the linear pipe 81 enables the bent pipe 82 to be fixed to the linear pipe 81.

The operation of the clamp cutter 7 (107) will be described. Each core yarn manufacturing unit manufactures a core yarn on a downstream side of each draft device 100. Where the core yarn is defective, it is cut by a cutter device (not shown in the drawings) and then subjected to a splicing operation. At this time, a control device provided in the core yarn manufacturing apparatus controls not only the driving of the cutter device and a splicing suction device but also the operation of the clamp cutter 7 (107).

When a package of the core fibers (CSY package 3 or CFY package 13) is to be replaced or the core fibers are broken during a normal operation (during manufacture of a core yarn), each core yarn manufacturing unit is stopped with no core fibers in the clamp cutter 7 (107) (with no core fibers clamped by the clamp cutter 7 (107)). When the core yarn manufacturing apparatus performs an automatic splicing operation as usual with no core fibers in the clamp cutter 7 (107), no core fibers are fed out to the draft device 100, naturally resulting in a failure in splicing. Thus, where the core yarn manufacturing unit is stopped with no core fibers in the clamp cutter 7 (107), core fibers need to be supplied to the introduction portion guiding the core fibers into the clamp cutter 7 (air nozzle 61 in the air suckers 6, 16, shown in FIGS. 8 and 9) so that a core yarn manufacturing operation can be resumed.

Thus, as shown in FIGS. 1, 2, 4, and 15, the core fiber supply device 1 is provided with a clamp cutter switch 17 manually operated to actuate only the clamp cutter 7 (107) independently. The clamp cutter switch 17 is provided on a front surface of a casing in which the clamp cutter 7 (or 107) is accommodated.

The clamp cutter switch 17 is a push switch that actuates the air sucker (CSY lair sucker 6 or CFY air sucker 16) and the clamp cutter 7 (or 107). The clamp cutter switch 17 is turned on when depressed by an external force exerted by an operator's finger or the like (when placed in a depressed position). The clamp cutter switch 17 is turned off when the external force is removed.

Specifically, for example, the clamp cutter switch 17 is operated as shown in FIG. 13 (clamp cutter 107) under circumstances described below. When each core yarn manufacturing unit is stopped, the clamp cutter 107 is stopped while clamping the core fibers, and the clamp cutter 107 is thus in the condition of the clamp cut step (FIG. 13B). During the clamp cut step (FIG. 13B), the core fibers are normally clamped by the clamp cutter 107. However, if the core yarn manufacturing unit is stopped in order to replace the package of the core fibers or as a result of breakage of the core fibers, no core fibers are present in the clamp cutter 107.

Under this condition (no core fibers are clamped), the operator first turns on the clamp cutter switch 17. Turning on the clamp cutter switch 17 actuates the air cylinder 178 (the air cylinder 178 moves in the urging direction A2) to form (open) a feed-out path of the core fibers in the clamp cutter 107. Further, the air sucker is actuated to inject compressed air into the feed-out path. The operator then brings the core fibers to the introduction portion guiding the core fibers into the clamp cutter 107 (air nozzle 61 in the air suckers 6, 16, shown in FIGS. 8 and 9). The core fibers are sucked and drawn into the operating air sucker and then fed out along the feed-out path in the clamp cutter 107.

Upon visually confirming that the core fibers have passed through the clamp cutter 107, the operator turns off the clamp cutter switch 17. Turning off the clamp cutter switch 17 activates the air cylinder 178 (the air cylinder 178 moves in the clamp direction B2) to close the feed-out path of the core fibers in the clamp cutter 107. The core fibers are thus clamped. At the same time, the air sucker is deactivated to stop the supply of compressed air to the interior of the feed-out path.

The above operation allows the clamp cutter 107 to clamp the core fibers. With these preparations made, a splicing operation can be successfully performed by allowing the core yarn manufacturing apparatus to perform an automatic splicing operation as usual. The above operation also applies to the clamp cutter 7.

Effects described below are produced by providing the core fiber supply device 1 with the manually operated clamp cutter switch 17 as in the case of the above configuration. The core fibers falling from the clamp cutter 7 (107) can be clamped before the core yarn manufacturing apparatus performs an automatic splicing operation. This makes it possible to increase the success rate of a splicing operation. The clamp cutter 7 (107) can also be independently operated and can thus be more easily checked for operation. This facilitates adjustments and maintenances.

The draft device 100 will be described with reference to FIGS. 5 and 14. In a spinning machine, the draft device 100 precedes a fine spinning device in the feed-out direction of the sheath fibers 9 to draft the sheath fibers 9 supplied to the fine spinning device. The draft device 100 is of a roller type and comprises plural (in the present embodiment, four) pairs of draft rollers. The draft device 100 drafts the sheath fibers 9 on the basis of the difference in peripheral speed between the draft rollers located adjacent to each other in the feed-out direction of the sheath fibers 9. The four pairs of draft rollers are provided on the right and left sides of the draft device 100. One draft device 100 drafts two sheath fibers 9.

Figure 14:
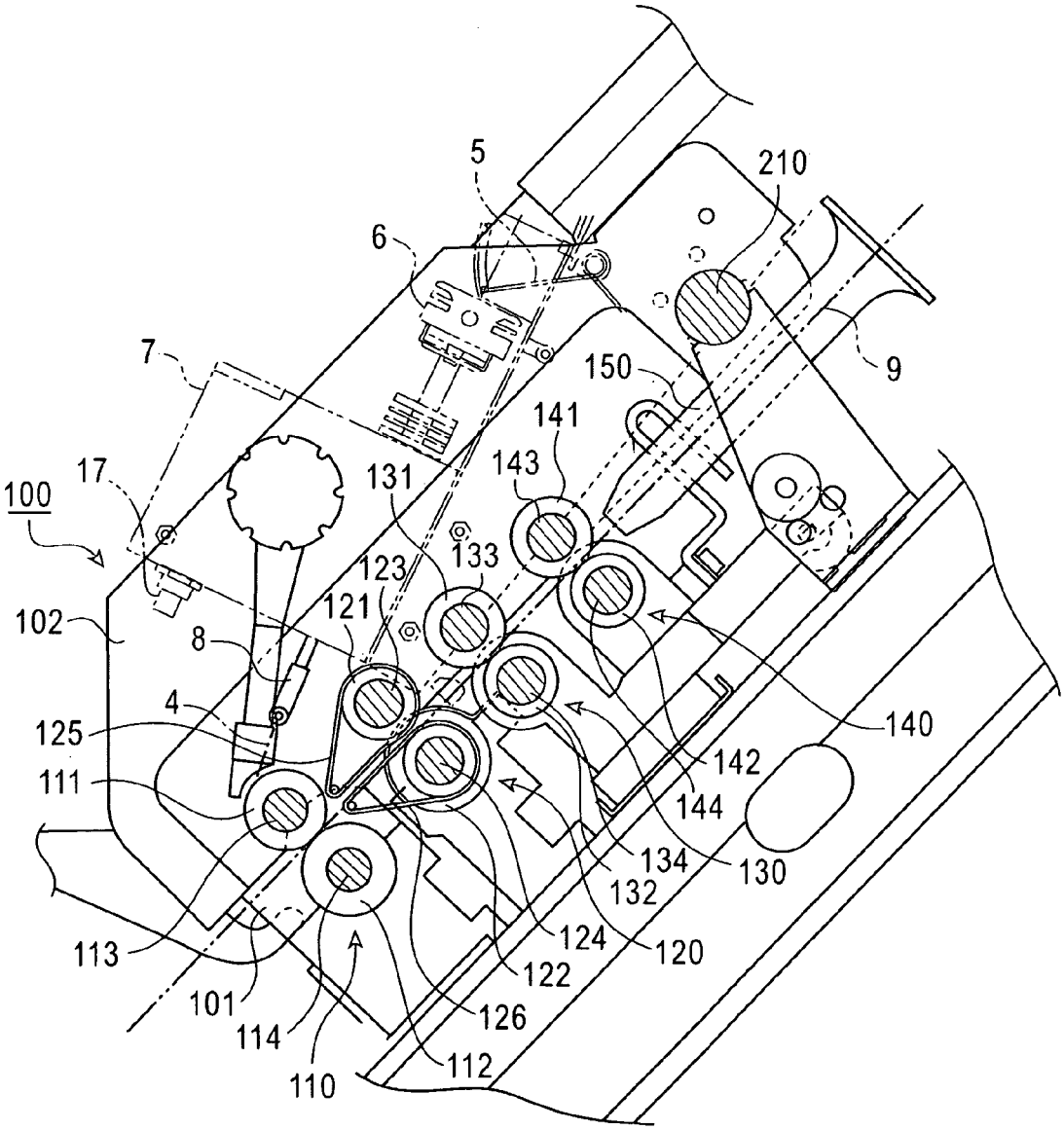
FIG. 14 is a side view showing the draft device and the nozzle pipe.

As shown in FIGS. 5 and 14, the four pairs of draft rollers include a front roller pair 110, a second roller pair 120, a third roller pair 130, and a back roller pair 140 arranged in this order in the feed-out direction of the sheath fibers 9; the front roller pair 110 is closest to the fine spinning device (not shown in the drawings), whereas the back roller pair 140 is farthest from the fine spinning device. Further, a trumpet 150 is placed on an upstream side of the back roller pair 140 in the feed-out direction of the sheath fibers 9. The trumpet 150 serves as means for guiding the sheath fibers 9 to the interior of each of the draft roller pairs.

Each draft roller pair is composed of a top roller and a bottom roller located opposite each other across the sheath fibers 9. The front roller pair 110 is composed of a front top roller 111 and a front bottom roller 112. The second roller pair 120 is composed of a second top roller 121 and a second bottom roller 122. The third roller pair 130 is composed of a third top roller 131 and a third bottom roller 132. The back roller pair 140 is composed of a back top roller 141 and a back bottom roller 142. An apron belt 125 is wound around an outer periphery of the second top roller 121, and an apron belt 126 is wound around an outer periphery of the second bottom roller 122. The sheath fibers. 9 are sandwiched between the apron belts 125, 126 so as to be in surface contact with each apron belt.

These draft rollers are supported by the respective roller shafts. The right and left front top rollers 111 are fixed to the opposite ends of a top roller shaft 113. The right and left second top rollers 121 are fixed to the opposite ends of a top roller shaft 123. The right and left third top rollers 131 are fixed to the opposite ends of a top roller shaft 133. The right and left back top rollers 141 are fixed to the opposite ends of a top roller shaft 143. The right and left front bottom rollers 112 are fixed to the opposite ends of a bottom roller shaft 114. The right and left second bottom rollers 122 are fixed to the opposite ends of a bottom roller shaft 124. The right and left third bottom rollers 132 are fixed to the opposite ends of a bottom roller shaft 134. The right and left back bottom rollers 142 are fixed to the opposite ends of a bottom roller shaft 144.

The draft device 100 comprises a draft base frame 101 fixed to the main frame 200 and which can be opened and closed, and a draft cradle 102 that can be opened and closed around the support base frame 210 with respect to the draft base frame 101. The bottom roller shafts 114, 124, 134, 144 are rotatably supported by the draft base frame 101, and the top roller shafts 113, 123, 133, 143 are rotatably supported by the draft cradle 102.

A belt type driving mechanism is provided at an end (which is closer to the frame than the corresponding draft roller) of each of the bottom rollers 114, 124, 134, 144 to drive the bottom rollers 114, 124, 134, 144, that is, the bottom draft rollers. The frictional contact between the opposite draft rollers causes the top draft rollers to be driven. This allows all draft rollers to be driven.

With reference to FIGS. 5, 14, and 15, a description will be given of how the core fiber supply device 1 delivers the core fibers to the draft device 100. As shown in FIG. 5, the core fiber supply device 1 is placed on each of the right and left sides of the draft device 100, and this prevents the core fiber supply device 1 and the draft device 100 from overlapping in a plan view. The core fibers fed out of the nozzle pipe 8 in the core fiber supply device 1 are guided to a peripheral surface of the front top roller 111 in the draft device 100 via an insertion guide 160 provided in the draft device 100. In this configuration, the ejection port of the nozzle pipe 8 is located away from each end surface of the front top roller 111 in the lateral direction. The core fibers are introduced into the draft device 100 "from its side".

As shown in FIG. 14, in a side view, the ejection port of the nozzle pipe 8 is located above the front top roller 111. In synchronism with rotation of the front top roller 111, the core fibers guided to the peripheral surface of the front top roller 111 are sandwiched between the apron belt 125 of the second top roller 121 and the front top roller 111, and the core fibers are then inserted into the sheath fibers 9 fed between the front top roller 111 and the front bottom roller 112. In this configuration, the sheath fibers 9 are fed from the back roller pair 140 to the second roller pair 110. Accordingly, the front top roller 111 and the second top roller 121 rotate in a direction in which the core fibers are drawn in between the front top roller 111 and the second top roller 121.

When the supply of the core fibers is started, the core fibers, passing through the nozzle pipe 8 and insertion guide 160, have their yarn end contact the peripheral surface of the front top roller 111. The contact friction between the yarn end and the peripheral surface of the front top roller 111 causes the core fibers to be sandwiched between the apron belt 125 and the front top roller 111 in synchronism with rotation of the front top roller 111. Thus, when the supply of the core fibers is started, the insertion of the core fibers into the-sheath fibers 9 can be completed simply by feeding the core fibers out of the nozzle pipe 8 with the draft device 100 and core fiber supply device 1 driven.

Figure 15A:
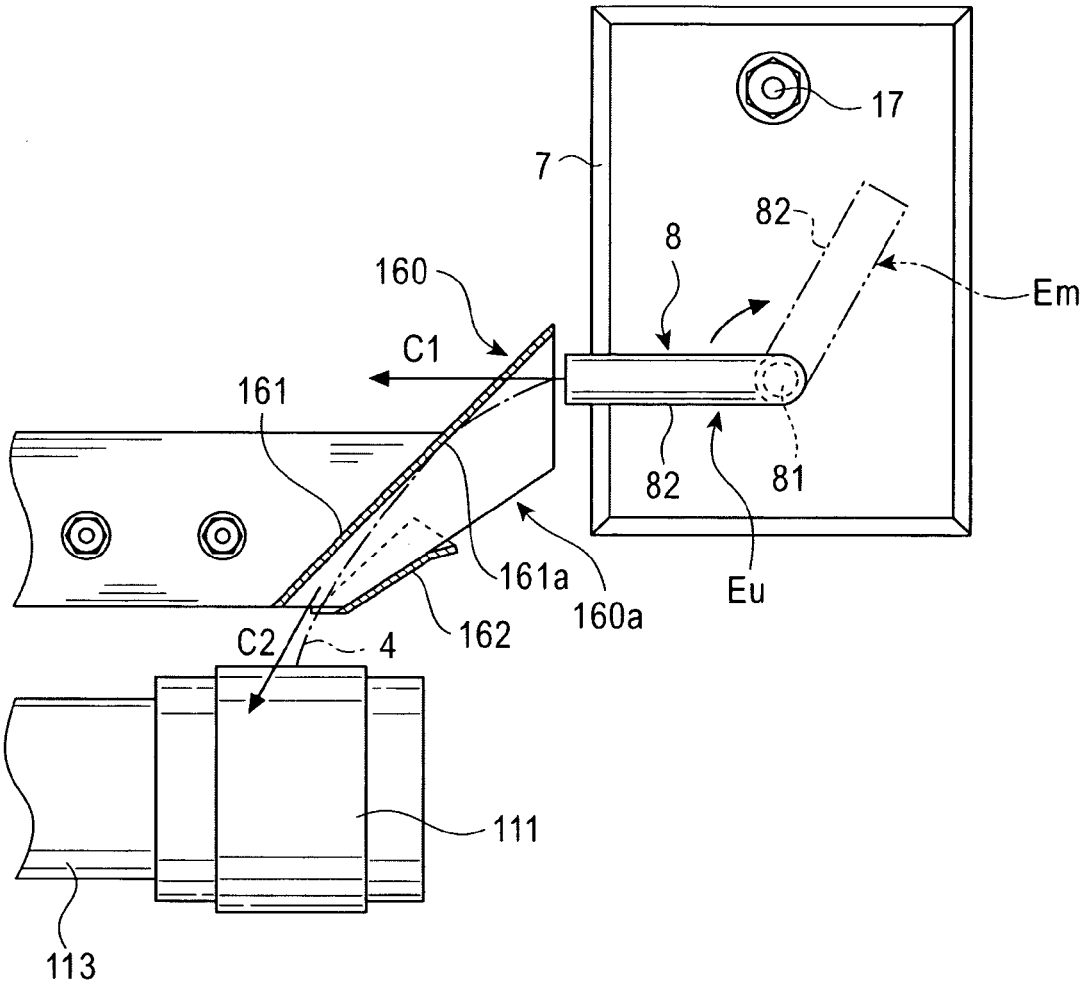
FIG. 15A is a front view of the insertion guide and FIG. 15B is a diagram of the insertion guide as viewed from a direction in which core fibers are guided.
Figure 15B:
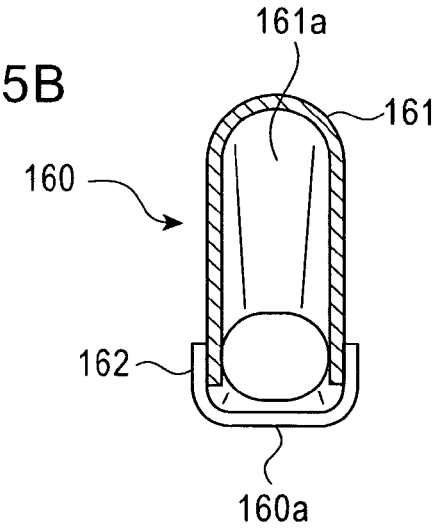

The insertion guide 160, shown in FIGS. 15A and 15B, is a cover that surrounds the guide path of the core fibers extending from the nozzle pipe 8 to the peripheral surface of the front top roller 111. The cover is composed of an upper cover 161 and a lower cover 162 fitted around the upper cover 161. The upper cover 161 and the lower cover 162 have U-shaped cross section as viewed from the direction of the guide path, and each of the upper cover 161 and the lower cover 162 is open in one of all the directions around the guide path. When the insertion guide 160 is mounted, the upper cover 161 is open in its bottom, whereas the lower cover 162 is open at its top.

The lower cover 162 is fitted around the upper cover so that the inside of the upper cover 161 lies opposite the inside of the lower cover 162, and this results in the insertion guide 160 surrounding the guide path. In this configuration, the lower cover 162 is shorter than the upper cover 161 in the direction of the path. Moreover, the upper cover 161 and the lower cover 162 are aligned with each other at the outlet (downstream side in the guide direction), and the bottom of the guide path is exposed at the connection with the nozzle pipe 8. The area from which the guide path is exposed is defined as an exposed portion 160*a* of the insertion guide 160.

As shown in FIG. 15A, an upper end (joint potion of the U-shaped cross section) of the upper cover 161 constitutes a guide wall 161*a* that guides and change the direction of the core fibers. The guide wall 161*a* is inclined obliquely downward from the nozzle pipe 8 toward the front top roller 111 side. A front and rear ends (forked parts of the U-shaped cross section) of the upper cover 161 and the lower cover 162 constitute a wall that prevents the core fibers from falling from the insertion guide 160.

The core fibers are fed out of the nozzle pipe 8 in a direction parallel to an axial direction of the front top roller 111 and toward the front top roller 111 side, and this direction is defined as a pre-guide direction C1. The core fibers fed out of the nozzle pipe 8 abut against the guide wall 161*a* in the pre-guide direction C1, and the core fibers are then guided obliquely downward along the inclination of the guide wall 161*a*. The core fibers are then fed out toward the front top roller 111, located obliquely below the insertion guide 160. The core fibers having its feed-out direction bent by the guide wall 161*a* are fed in a post-guide direction C2.

When the core fibers having their yarn end held by the clamp cutter 7 start to be fed out, the air sucker is driven to inject air from the nozzle pipe 8 in synchronism with the feed-out of the core fibers. Not only the core fibers but also injected air abuts against the guide wall 161*a* to reduce the air pressure. This prevents the sheath fibers 9 in the draft device 100 from being affected even if the air injected from the nozzle pipe 8 partly reaches the draft device 100 side.

In addition to the guide wall 161*a*, an arrangement described below serves to prevent the sheath fibers 9 from being affected by the air injected from the nozzle pipe 8. An inlet of the insertion guide 160 is wider than the outlet of the nozzle pipe 8 and is provided with the above exposed part 160*a*. This arrangement diffuses the air from the nozzle pipe 8 to facilitate a decrease in air pressure.

The nozzle pipe 8 is also movable so that it can be connected to or separated from the insertion guide 160. As previously described, the nozzle pipe 8 is composed of the linear pipe 81 and the bent pipe 82, fitted into the linear pipe 81. Since the linear pipe 81 is a rigid member, while the bent pipe 82 is an elastic member, the bent pipe 82 is attachable to and removable from the bent pipe 82. The bent pipe 82 is also rotatable in the axial direction of the linear pipe 81 so as to be fixed at an arbitrary position. Consequently, the position (attaching angle) where the bent pipe 82 is attached to the linear pipe 81 may be the same as that (connected position Eu) where the nozzle pipe 8 is connected to the insertion guide 160 or that (released position Em) where the nozzle pipe 8 leaves the insertion guide 160. The thus movable nozzle pipe 8 prevents the core fibers from being inadvertently fed out to the draft device 100 side during, for example, a manual operation or the like.

On the other hand, the above core yarn manufacturing apparatus is limited in the success rate of yarn insertion, that is, the success rate of insertion of the elastic yarn into the sheath fibers being drafted by the draft device. Since an inserting guide pipe is cylindrical, air injected from the guide pipe during yarn insertion moves unstably. This may cause the core fibers fed out through the guide pipe to be inserted into the sheath fibers at an incorrect position. Another object of the present invention is thus to improve the success rate of yarn insertion in a core yarn manufacturing apparatus that manufactures a core yarn using an elastic yarn as core fibers.

With reference to the drawings, a description will be given of a core yarn manufacturing apparatus 1 in accordance with an other embodiment of the present invention. The core yarn manufacturing apparatus 1 manufactures a core yarn composed of an elastic yarn constituting core fibers and covered with sheath fibers.

Figure 16:
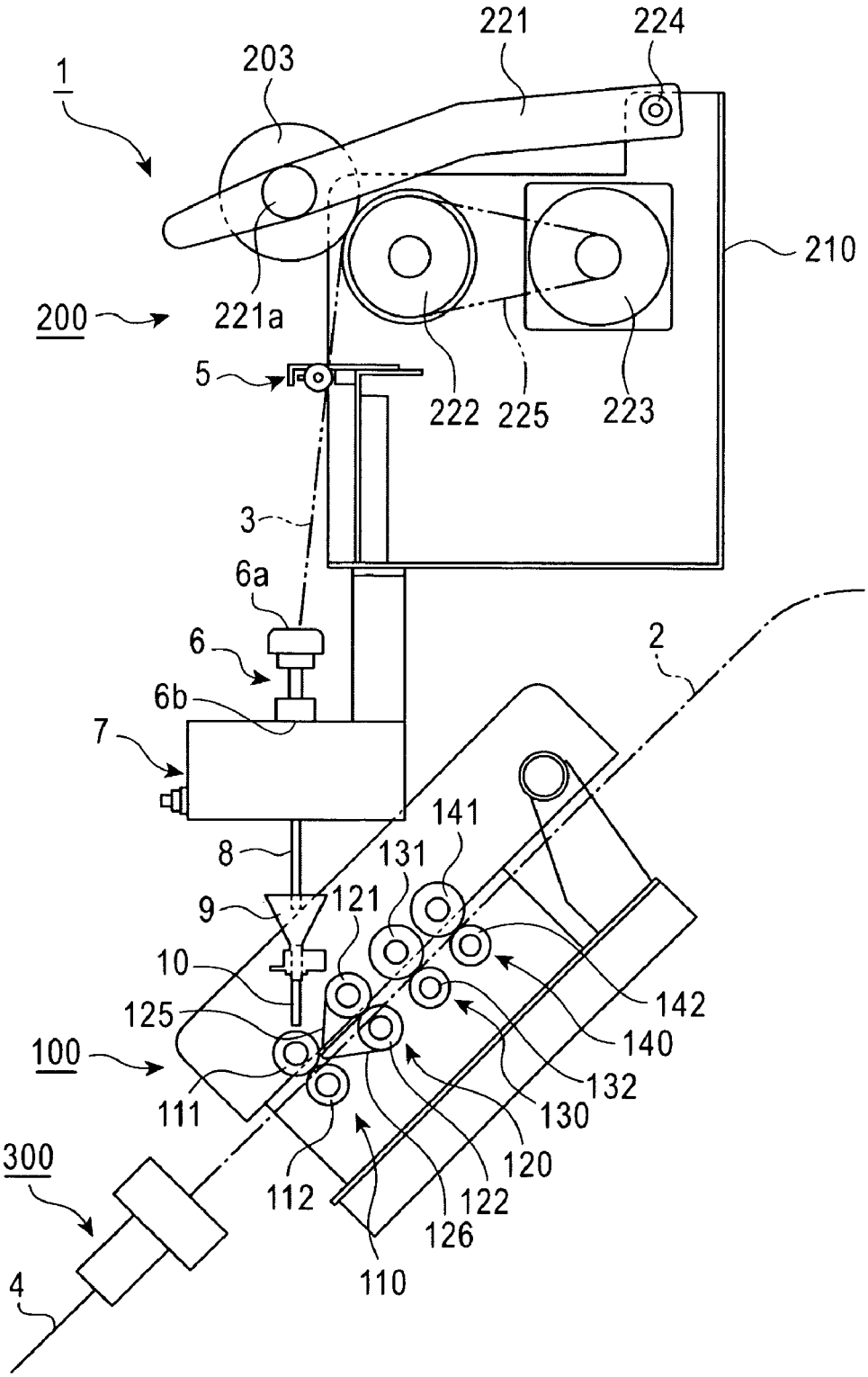
FIG. 16 is a side view showing an essential part of a core yarn manufacturing apparatus.

As shown in FIG. 16, the core yarn manufacturing apparatus 1 comprises the draft device 100 that drafts sheath fibers 2 for a core yarn, an elastic yarn supply device 200 that supplies an elastic yarn 3 constituting core fibers, and a pneumatic fine spinning device 300 that spins the sheath fibers into which the elastic yarn 3 has been inserted, to form a core yarn 4. The core yarn manufacturing apparatus 1 also comprises a winding device (not shown in the drawings) that winds the manufactured core yarn 4.

In the description below, the core yarn manufacturing apparatus 1 is the whole apparatus relating to the manufacture of a single core yarn for convenience. However, the device relating to the manufacture of a single core yarn may be defined as a core yarn manufacturing unit. Instead, an apparatus composed of a combination of a large number of manufacturing units may be called a core yarn manufacturing apparatus.

In FIG. 16, the front side of machine body of the core yarn manufacturing apparatus 1 corresponds to the left side of the figure, and the right side of FIG. 16 corresponds to the rear side of the machine frame. The vertical direction of FIG. 16 coincides with the vertical direction of the core yarn manufacturing apparatus 1, and a direction toward or away from the reader coincides with the lateral direction of the core yarn manufacturing apparatus 1. In the present specification, the front and rear (front and rear surfaces), top and bottom, and right and left of the core yarn manufacturing apparatus 1 are defined as described above.

The draft device 100 will be described with reference to FIG. 16. The draft device 100 precedes the pneumatic fine spinning device 300 in the feed-out direction of the sheath fibers 2. The draft device 100 drafts the sheath fibers 2 supplied to the pneumatic fine spinning device 300. The draft device 100 and the pneumatic fine spinning device 300 constitute a pneumatic spinning device. The draft device 100 is of a multi-line type and comprises plural (in the present embodiment, four) pairs of draft rollers sandwiching the sheath fibers 2. The draft device 100 drafts the sheath fibers 2 on the basis of the difference in peripheral speed between the draft rollers located adjacent to each other in the feed-out direction of the sheath fibers 9.

The four pairs of draft roller pairs include the front roller pair 110, the second roller pair 120, the third roller pair 130, and the back roller pair 140 arranged in this order in the feed-out direction of the sheath fibers 9; the front roller pair 110 is closest to the pneumatic fine spinning device 300, whereas the back roller pair 140 is farthest from the pneumatic fine spinning device 300. These draft roller pairs are arranged rearward and upward from the pneumatic fine spinning device 300. The sheath fibers 2 are drafted by passing them through the back roller pair 140, the third roller pair 130, and the front roller pair 110 in this order. The sheath fibers 2 are thus fed out frontward and downward from a rear upper position in the apparatus.

Each draft roller pair is composed of a top roller and a bottom roller located opposite each other across the sheath fibers 2. The front roller pair 110 is composed of the front top roller 111 and the front bottom roller 112. The second roller pair 120 is composed of the second top roller 121 and the second bottom roller 122. The third roller pair 130 is composed of the third top roller 131 and the third bottom roller 132. The back roller pair 140 is composed of the back top roller 141 and the back bottom roller 142. The apron belt 125 is wound around an outer periphery of the second top roller 121, and the apron belt 126 is wound around an outer periphery of the second bottom roller 122. The sheath fibers 2 are sandwiched between the apron belts 125, 126 so as to be in surface contact with each apron belt.

The elastic yarn supply device 200 will be described with reference to FIG. 16. The elastic yarn supply device 200 supports an elastic yarn package 203 and winds the elastic yarn 3 out from the elastic yarn package 203. The devices (including a cradle 221 and so on described later) constituting the elastic yarn supply device 200 are supported in a base frame 210. The elastic yarn package 203 is formed by winding the elastic yarn 3 around a bobbin. The elastic yarn supply device 200 comprises the cradle 221 that supports the elastic yarn package 203, a package driving drum 222 that contacts and rotates the elastic yarn package 203 in synchronism with rotation of the package driving drum 222, and a package driving motor 223 serving as a driving source for the package driving drum 222.

The cradle 221 is an arm that is pivotable by a rotating support shaft 224 placed at a rear upper end of the base frame 210, and the cradle 221 comprises a bobbin holder 221*a* that enables the bobbin of the elastic yarn package 203 to be held and released. The package driving drum 222 is placed in front of and below the rotating support shaft 224. Tilting the cradle 221 forward brings the elastic yarn package 203 supported by the cradle 221 in contact with the package driving drum 222. The package driving motor 223 is placed behind the package driving drum 222. The package driving motor 223 transmits power to the package driving drum 222 via a belt 225.

The following are arranged between the elastic yarn supply device 200 and the draft device 100 along the feed-out path of the elastic yarn: the yarn feeler 5, the air sucker 6, the clamp cutter 7, the nozzle pipe 8, a funnel-like guide 9, and the guide pipe 10.

The yarn feeler 5 detects whether or not the elastic yarn 4 extending from the elastic yarn supply device 200 to the draft device 100 is present.

The clamp cutter 7 comprises both a cutter serving as means for cutting the core fibers and a clamp serving as means for gripping the cut core fibers. During, for example, an operation of splicing the core yarn 4, the clamp cutter 7 cuts the elastic yarn 3 and holds (clamps) its yarn end. The clamp cutter 7 can also release the elastic yarn 3 so that it can be fed out.

The air sucker 6 comprises a sucking portion 6*a* driven by external air supply means (compressor or the like) to suck air and an ejection portion 6*b* that ejects air. The air sucker 6 can suck and catch the elastic yarn 3 in itself and exert an ejection pressure to blow the elastic yarn 3 out of the guide pipe 10.

When the air sucker 6 is driven with the elastic yarn 3 released from the clamp cutter 7, the elastic yarn 3 in the clamp cutter 7 is passed through the nozzle pipe 8, funnel-like guide 9, and guide pipe 10 under the ejection pressure from the ejection portion 6*b*. The elastic yarn 3 then rushes onto an outer peripheral surface 111*a* of the front top roller 111 of the draft device 100.

The feed-out path of the elastic yarn 3 in the clamp cutter 7 is kept airtight, and the clamp cutter 7 and the nozzle pipe 8 are connected together so as to be in communication and to be kept airtight. The nozzle pipe 8 and the guide pipe 10 are connected together via the funnel-like guide 9; the guide pipe 10 is located on a downstream side of the nozzle pipe 8 in the yarn feed direction. The funnel-like guide 9 has an inner diameter larger than the outer diameter of the nozzle pipe 8 and is open to the-exterior. However, an outlet of the funnel-like guide 9 has an inner diameter equal to the outer diameter of the guide pipe 10 so as to maintain air-tightness. In this configuration, activation of the air sucker 6 causes the ejection portion 6*b* to inject air to exert a force feeding the elastic yarn 3 between the clamp cutter 7 and the nozzle pipe 8. The elastic yarn 3 thus rushes into the draft device 100 (against the outer peripheral surface 111*a* of the front top roller 111) through the guide pipe 10. At the same time, the air partly escapes from the funnel-like guide 9 to reduce the air ejection pressure from the guide pipe 10. This prevents the sheath fibers 2 fed through the draft device 100 from being affected by the air from the guide pipe 10.

Figure 17:
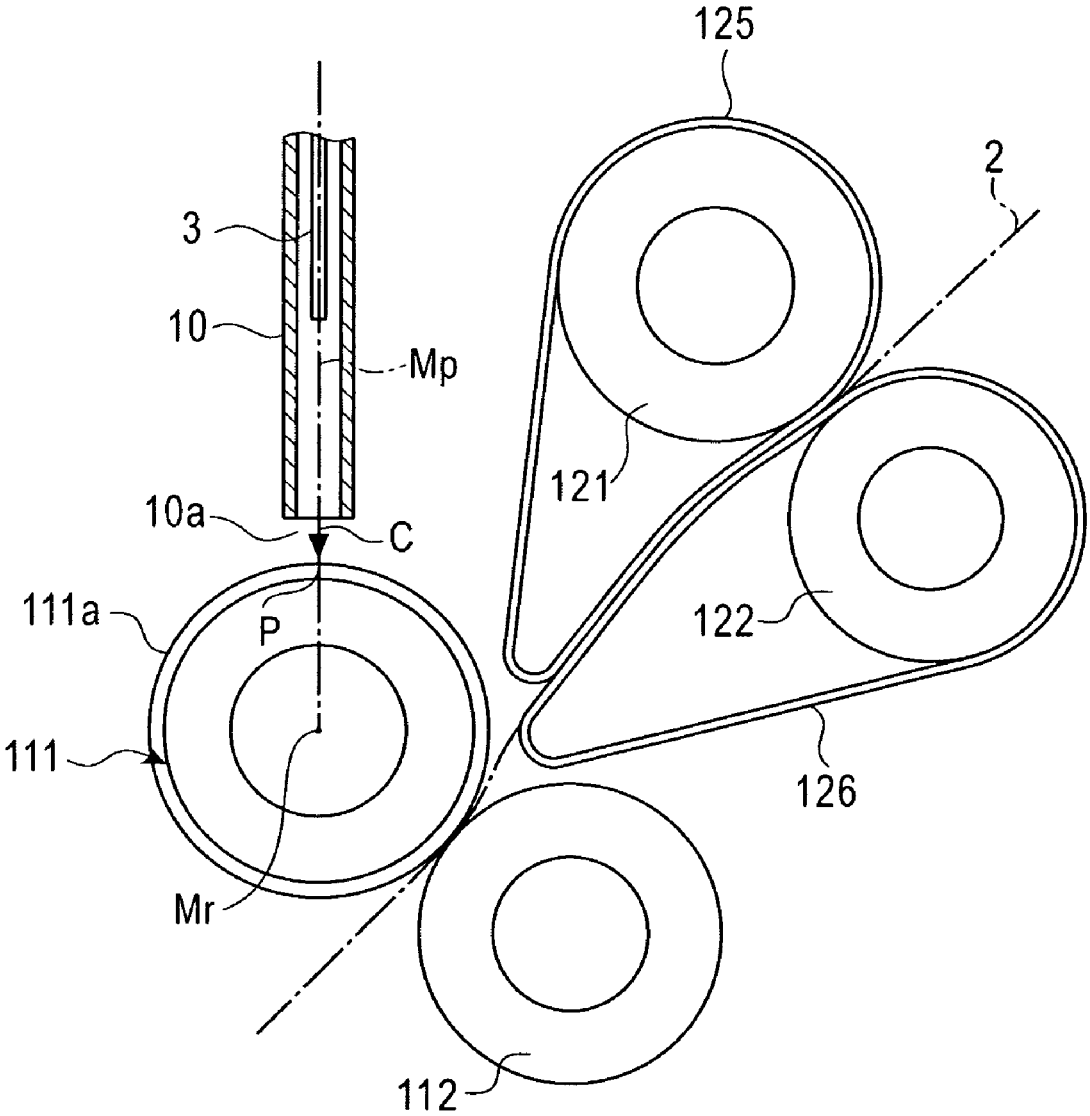
FIG. 17 is a side view of a peripheral part of a front top roller, showing a path through which an elastic yarn rushes onto the front top roller.
Figure 18:
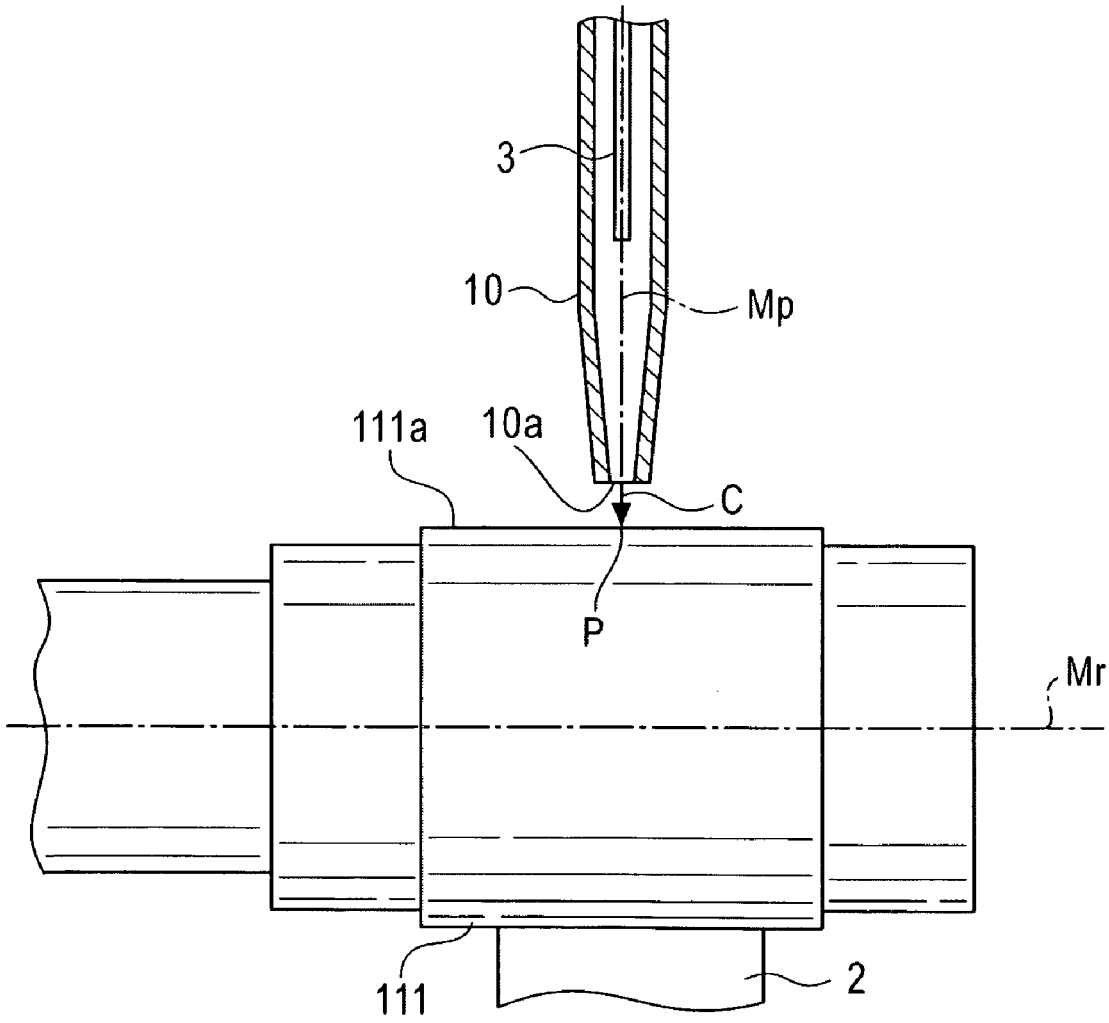
FIG. 18 is a front view of the peripheral part of the front top roller, showing the path through which the elastic yarn rushes onto the front top roller.

With reference to FIGS. 17 and 18, a description will be given of the insertion of the elastic yarn 3 into the sheath fibers 2. When the manufacture of a core yarn is suspended and then resumed owing to the need for splicing or the like, the elastic yarn 3 held in the clamp cutter 7 is newly inserted into the sheath fibers 2 being drafted in the draft device 100. This corresponds to the insertion of the elastic yarn 3 into the sheath fibers 2. At this time, the air sucker 6 is driven to blow the elastic yarn 3 held by the clamp cutter 7, out of the guide pipe 10. The elastic yarn 3 thus rushes onto the outer peripheral surface 111*a* of the front top roller 111. The yarn end of the elastic yarn 3 rushes onto the outer peripheral surface 111*a* at a rush-in position P. In synchronism with rotation of the front top roller 111, the elastic yarn 3 having rushed onto the outer peripheral surface 111*a* is fed to between the front top roller 111 and the front bottom roller 112. The elastic yarn 3 is then inserted into the sheath fibers 2.

In the above configuration, the rush-in position P of the elastic yarn 3 is set on the outer peripheral surface 111*a* of the front top roller 111, and this prevents the air drivingly ejected from the guide pipe 10 by the air sucker 6 from being blown directly against the sheath fibers 2. The air ejected from the guide pipe 10 is thus inhibited from affecting the sheath fibers 2.

The success rate of yarn insertion depends on how the elastic yarn 3 having rushed onto the front top roller 111 follows its rotation. When the yarn end of the elastic yarn 3 having contacted (rushed onto) the outer peripheral surface 111*a* adheres to the outer peripheral surface 111*a* without leaving it, the elastic yarn 3 follows the rotating front top roller 111, and is then fed directly between the front top roller 111 and the front bottom roller 112. The yarn is thus successfully inserted. In contrast, when the yarn end of the elastic yarn 3 having contacted (rushed onto) the outer peripheral surface 111*a* leaves the outer peripheral surface 111*a*, the elastic yarn 3 may be inserted into the sheath fibers 2 at an inappropriate position or may slip out without being inserted into the sheath fibers 2. The yarn insertion is thus likely to fail.

Thus, to increase the success rate of yarn insertion, a rush-in path C and a rush-in position P are set as described below; the elastic yarn 3 travels along the rush-in path C before rushing onto the front top roller 111 and rushes onto the outer peripheral surface 111*a* of the front top roller 111 first at the rush-in position P.

The guide pipe 10 in accordance with the present embodiment is a linearly cylindrical member, and this makes linear the guide path of the elastic yarn 3 formed in the guide pipe 10. Where the guide path in the guide pipe 10 is linear, the rush-in path C, located on an extension of the guide path, is also linear. In this configuration, the rush-in path C, along which the elastic yarn 3 rushes onto the front top roller 111, is defined by the shape of an outlet side of the guide pipe 10. Thus, even with a bent portion in the middle of the guide pipe 10, forming at least the outlet side of the guide pipe 10 to be linear makes the rush-in path C linear.

The rush-in path C is formed on a normal of the outer peripheral surface 111*a* of the front top roller 111. The rush-in position P, that is, the terminal position of the rush-in path C, corresponds to the intersecting point between the normal and the outer peripheral surface 111*a*. The axis Mr of the front top roller 111 is thus located on an extension of the rush-in path C. The layout of the guide pipe 10 with respect to the draft device 100, that is, the arrangement and orientation (arranged position) of the guide pipe 10, is set so as to form such a rush-in path C.

The elastic yarn 3 is drivingly blown out of the guide pipe 10 toward the axis Mr (in the normal direction) by the air sucker 6, and the elastic yarn 3 then reaches the rush-in position P on the outer peripheral surface 111*a* of the front top roller 111. When the elastic yarn 3 is thus rushed onto the outer peripheral surface 111*a* from the normal direction, it is more unlikely to slip and more likely to follow rotation of the front top roller 111 than where it is rushed from another direction (in which it does not pass through the axis Mr). This increases the success rate of insertion of the elastic yarn 3 into the sheath fibers 2.

The reason for the above is as described below. The direction in which the elastic yarn 3 rushes onto the outer peripheral surface 111*a* varies the magnitude of an impact on the yarn end of the elastic yarn 3 at the time of contact (rush-in). This in turn varies the degree to which the fibers constituting the yarn end of the elastic yarn 3 come loose. The loose fibers at the yarn end of the elastic yarn 3 causes the yarn end of the elastic yarn 3 to adhere, at the time of the contact (rush-in), to the outer peripheral surface 111*a* without leaving it. When the elastic yarn 3 rushes onto the outer peripheral surface 111*a* from the normal direction, the yarn end of the elastic yarn 3 entirely contacts the outer peripheral surface 111*a* without slippage than where it is rushed from another direction (in which it does not pass through the axis Mr). Consequently, the yarn end impacts the outer peripheral surface 111*a* hard at the time of the contact (rush-in) and thus becomes likely to come loose. Thus, the success rate of yarn insertion is increased by rushing the elastic yarn 3 onto the outer peripheral surface 111*a* from the normal direction.

Further, as shown in FIGS. 17 and 18, the separation between the outlet 10*a* of the guide pipe 10 and the rush-in position P (length of the rush-in path C) is desirably set at about 2 to 8 mm.

Furthermore, the linearly cylindrical guide pipe 10 is oriented in the vertical direction (arranged position), and the guide path and rush-in path C of the elastic yarn 3 in the guide pipe 10 also extend along the vertical direction. The elastic yarn 3 drivingly blown out of the guide pipe 10 by the air sucker 6 rushes onto the outer peripheral surface 111*a* of the front top roller 111 at the rush-in position P from immediately above.

Now, the shape of outlet 10*a* of the guide pipe 10 will be described with reference to FIGS. 17, 18, and 19. The elastic yarn 3 is fed out by the ejection pressure from the air sucker 6. Consequently, the shape of outlet 10*a* of the guide pipe 10 affects the direction in which the elastic yarn 3 rushes onto the outer peripheral surface 111*a* of the front top roller 111. The outlet 10*a* of the guide pipe 10 is shaped so that the rush-in direction will not deviate from the rush-in position P in the axial direction of the front top roller 111.

Figure 19:
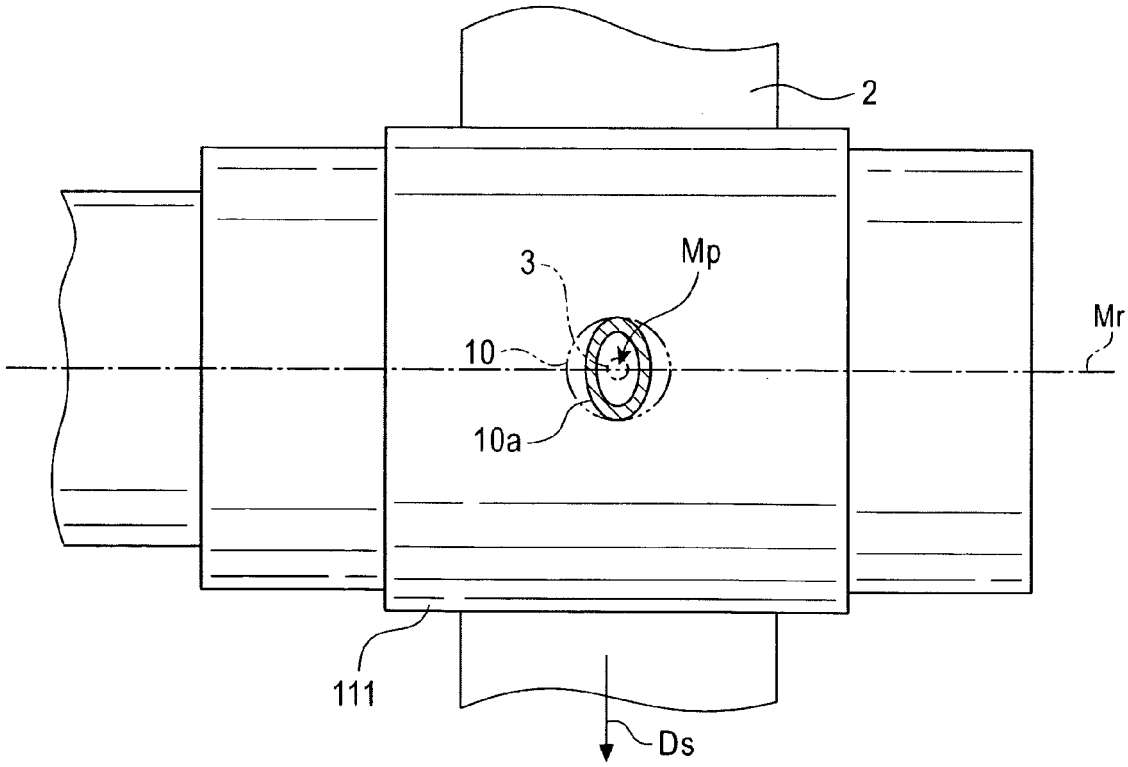
FIG. 19 is a sectional plan view showing the shape of an outlet of a guide pipe.

As shown in FIG. 19, the outlet 10*a* of the guide pipe 10 is elliptical, and the major axis of the ellipse extends along a feed-out direction Ds of the sheath fibers 2 in the draft device 100.

Thus, air ejected from the outlet 10*a* of the guide pipe 10 is diffused in the feed-out direction Ds but not in the axial direction (direction of the axis Mr) of the front top roller 111, with respect to the center axis Mp of the guide pipe 10. Thus, in spite of the diffusion of the air ejected from the outlet 10*a* of the guide pipe 10, the rush-in direction of the elastic yarn 3 is prevented from shifting in the axial direction (direction of the axis Mr) of the front top roller 111.

Where the rush-in direction of the elastic yarn 3 shifts in the direction of the axis Mr, the elastic yarn 3 may not be inserted into the sheath fibers 2 at their width-wise center but at a position laterally deviating from the width-wise center, or the insertion of the elastic yarn 3 into the sheath fibers 2 may fail. The insertion of the elastic yarn 3 into the sheath fibers 2 is thus degraded. The guide pipe 10 configured as described above avoids shifting the rush-in direction of the elastic yarn 3 in the direction of the axis Mr, thus preventing the above failure.

A core yarn manufacturing apparatus in accordance with claim 11 is configured in claim 10 as described below. The core yarn manufacturing apparatus comprises a multi-line draft device that drafts sheath fibers of a core yarn, an elastic yarn supply device that supplies an elastic yarn constituting core fibers of the core yarn, a guide pipe that sets the position where the elastic yarn rushes into the draft device, and an air sucker that blows the elastic yarn out of the guide pipe toward the rush-in position. The rush-in position is set on the outer peripheral surface of the front top roller provided in the draft device. The layout of the guide pipe with respect to the draft device is set so that the substantial axial position of the front top roller is located on an extension of a rush-in path of the elastic yarn extending from the outlet of the guide pipe to the rush-in position.

A core yarn manufacturing apparatus 1 in accordance with the present embodiment comprises the four-line draft device 100, the elastic yarn supply device 200, and the pneumatic fine spinning device 300. The fine spinning device 300 is not limited to the pneumatic type. The following are arranged between the draft device 100 and the elastic yarn supply device 200 along the feed-out path of the elastic yarn 3: the yarn feeler 5, the air sucker 6, the clamp cutter 7, the nozzle pipe 8, the funnel-like guide 9, and the guide pipe 10.

The rush-in position P where the elastic yarn 3 rushes into the draft device 100 is set on the outer peripheral surface of the front top roller 111, which belongs to one of the four draft roller pairs provided in the draft device 100 and which is located closest to the pneumatic fine spinning device 300 among the draft rollers. The substantial axial position of the front top roller is located on an extension of the rush-in path C of the elastic yarn 3 extending from the outlet 10*a* of the guide pipe 10 to the rush-in position P. The layout (arranged position and orientation) of the guide pipe 10 with respect to the draft device 100 is set so as to establish the above positional relationship.

The above configuration avoids blowing air ejected from the guide pipe directly against the sheath fibers in the draft device. The above configuration also makes the yarn end of the rushing elastic yarn unlikely to slip on the outer peripheral surface of the front top roller, and it instead makes the yarn end likely to follow the rotating front top roller. This minimizes the adverse effect of the air ejected from the guide pipe on the sheath fibers in the draft device, while increasing the success rate of insertion of the elastic yarn into the sheath fibers.

The core yarn manufacturing apparatus in accordance with claim 12 in claim 10 or claim 11 is configured as follows. The outlet of the guide pipe is elliptical.

The apparatus thus stabilizes the behavior of the yarn inserted into the sheath fibers. This increases the success rate of insertion of the elastic yarn into the sheath fibers.

The core yarn manufacturing apparatus in accordance with the present invention will be described in brief.

The core yarn manufacturing apparatus in accordance with the first invention comprises a draft device that drafts sheath fibers of a core yarn and a core fiber supply device that supplies core fibers of the core yarn. The core fiber supply device is configured so that a feed-out path of the core fibers in the core fiber supply device is inclined above the draft device in such a manner that a front of the feed-out path is lower than a rear of the feed-out path with respect to a front surface side of a machine frame, and a wind-out device and a yarn guide are provided in a rear upper part of a base frame of the core fiber supply device, the wind-out device supporting an elastic yarn package and winding out the core fibers constituting an elastic yarn, the yarn guide guiding the core fibers drawn out from a filament yarn package located behind the core fiber supply device, the core fibers constituting a filament yarn.

The apparatus can thus deal with core fibers whether they constitute an elastic yarn or a filament yarn. The apparatus thus has improved general purpose properties.

The core yarn manufacturing apparatus in accordance with the second invention corresponds to the first invention configured as follows. The core yarn manufacturing apparatus further comprises a moving mechanism that is able to move the base frame upward with respect to the draft device.

In the core fiber supply device 1 in accordance with the present embodiment, the base frame 10 is provided in the main frame 200 of the core yarn manufacturing apparatus so as to be rotatable around the rotating support shaft 31, and the base frame 10 can be locked at two positions within the range of its rotation. The base frame 10 is provided with the support arm 32, which has the engaging portions 32*a*, 32*b* at the opposite ends of the support arm 32 and which is rotatable via the arm 33. The engaging portions 32*a*, 32*b* can be engaged with the support line shaft 210, provided in the main frame 200. Engaging either engaging portion 32*a* or 32*b* with the support line shaft 210 causes the base frame 10 to be located at one of two different vertical positions.

This arrangement enables the core fiber supply device to withdraw to above the draft device as required. This improves the maintainability of the draft device.

The core yarn manufacturing apparatus in accordance with the third invention in the first or second invention is configured as follows. The wind-out device and yarn guide are laid out so that, in the core fiber supply device, a feed-out path of the elastic yarn starting from the wind-out device overlaps a feed-out path of the filament yarn starting from the yarn guide, and a clamp cutter for the core fibers and an air sucker that feeds the core fibers out to the clamp cutter are arranged on the feed-out path of the elastic yarn.

The clamp cutter 7 in accordance with the present embodiment is used for both the filament yarn and the elastic yarn. However, dedicated clamp cutters for the different core fibers may be selectively attached to the base frame 10 every time the core fibers are switched. The present embodiment uses either the CSY air sucker 6 or the CFY air sucker 16; these air suckers 6, 16 are selectively attached to the base frame 10.

This reduces the number of parts required, while ensuring general purpose properties required to deal with the different core fibers.

The core fiber supply device in accordance with the fourth invention in manufacturing a core yarn formed of core fibers covered with sheath fibers, is a device to supply the core fibers. The core fiber supply device comprises modules relating to supply of the core fibers and a base frame to which each of the modules is attached. Each of the modules is configured to be able to attach to the base frame so as to form an individual unit.

The core fiber supply device 1 in accordance with the present embodiment comprises the CSY modules relating to the supply of the elastic yarn 4 and the CFY modules relating to the supply of the filament yarn 14. The CSY modules are composed of the CSY feed-out device 2, the yarn feeler 5, the CSY air sucker 6, the clamp cutter 7, and the nozzle pipe 8. The CFY modules are composed of the CFY tenser 11, the CFY yarn guide 12, the yarn feeler 5, the CFY air sucker 16, the clamp cutter 7, and the nozzle pipe 8. The modules (CSY and CFY modules) are formed as individual units and are supported by the attaching frame used to attach the module to the base frame 10. Simply attaching the attaching frame to the base frame 10 allows the module supported by the attaching frame to be attached to the base frame 10.

This allows the modules to be easily installed, removed, and replaced.

The core fiber supply device in accordance with the fifth invention in the fourth invention configured as follows. The modules comprise CSY modules used if an elastic yarn is used as the core fibers and CFY modules used where a filament yarn is used as the core fibers. Each CSY module comprises a CSY feed-out device which supports an elastic yarn package and which feeds out the elastic yarn, a CSY clamp cutter, a CSY yarn feeler, and a CSY air sucker. Each CFY module comprises a CFY yarn guide that guides a filament yarn drawn out from a fi lament yarn package, a CFY clamp cutter, a CFY yarn feeler, and a CFY air sucker.

In the present embodiment, the CSY clamp cutter is also used as the CFY clamp cutter. The CSY yarn feeler is also used as the CFY yarn feeler. However, different modules may of course be provided for the respective core fibers.

This arrangement enables the modules to be arbitrarily combined into a supply device used for both elastic yarns and filament yarns, a supply device dedicated for elastic yarns, or a supply device dedicated for filament yarns. This provides the core fiber supply device with improved general purpose properties.

The core fiber supply device in accordance with the sixth invention in the fifth invention is configured as follows. The CSY clamp cutter is also used as the CFY clamp cutter. The CSY yarn feeler is also used as the CFY yarn feeler. The CSY air sucker and the CFY air sucker are selectively attached to the base frame.

This reduces the number parts required while ensuring general purpose properties required to deal with different core fibers.

The clamp cutter in accordance with the seventh embodiment is provided in a device that operates in manufacturing a core yarn formed of core fibers covered with shear fibers, to supply the core fibers. The clamp cutter comprises a support frame, a follower clamp piece and an operating clamp piece which are movably supported by the support frame in a direction crossing the feed-out path, an actuator that moves the operating clamp piece forward and backward in a direction crossing a feed-out path of the core fibers, follower urging means for urging the follower clamp piece in one direction in the above described direction, a movable blade fixed to the operating clamp piece, and a fixed blade placed on a downstream side, in the feed-out path, of the follower clamp piece and the operating clamp piece and fixed to the support frame. The follower clamp piece and the operating clamp piece constitute a clamp that sandwiches the core fibers. The movable blade and the fixed blade constitute a cutter that cuts the core fibers. When the operating clamp piece is located so as to push in the follower clamp piece against an urging force of the follower urging means, the movable blade and the fixed blade are closed.

In the first embodiment (clamp cutter 7), the projecting portion 73*c* of the first moving member 73 and the clamp surface 74*b*, formed on the second moving member 74, constitute a clamp sandwiching the core fibers between them. The first moving member 73 is urged by the compression spring 77, and the second moving member 74 is driven by the air cylinder 78. Thus, the projecting portion 73*c* corresponds to the follower clamp piece, whereas the clamp surface 74*b* (and its peripheries) corresponds to the operating clamp surface. The compression spring 77 corresponds to the follower urging means. Further, in the first embodiment (clamp cutter 7), the movable blade surface 74*c* and the fixed blade 75 constitute a cutter serving as means for cutting the core fibers; the movable blade surface 74*c* is formed on the moving second moving member 74, and the fixed blade 75 is fixed to the support frame 71. The fixed blade 75 is shaped by the cutter hole 75*a*. As shown in FIG. 11A and 11B, when the second moving member 74 is located so as to push in the projecting portion 73*c* against the urging force of the compression spring 77, the cutter hole 75*a* is closed by the movable blade surface 74*c* to block the feed-out path of the core fibers. The core fibers are thus cut.

In the second embodiment (clamp cutter 107), the follower clamp piece 173*a* of the first moving member 173 and the clamp surface 174*b*, formed on the second moving member 174, constitute a clamp sandwiching the core fibers between them. The clamp surface 174*b* (and its peripheries) corresponds to the operating clamp surface. The first moving member 173 is urged by the compression spring 177, corresponding to the follower urging means. The second moving member 174 is driven by the air cylinder 178. Further, in the second embodiment (clamp cutter 7), the movable blade 190 and the fixed blade 175 constitute a cutter serving as means for cutting the core fibers; the movable blade 190 is fixed to the moving second moving member 174, and the fixed blade 175 is fixed to the support frame 71. The movable blade 190 is shaped by the cutter hole 190*a*. The fixed blade 170 is shaped by the cutter hole 170*a*. As shown in FIGS. 11A and 11B, when the second moving member 174 is located so as to push in the follower clamp piece 173*a* against the urging force of the compression spring 177, the cutter holes 190*a*, 175*a* are closed to block the feed-out path of the core fibers. The core fibers are thus cut.

The above configuration allows a driving timing for the clamp and a driving timing for the cutter to be controlled on the basis of driving by the single actuator. This enables the appropriate setting of the driving timing for the clamp and the driving timing for the cutter as well as a reduction in the number of actuators required.

The clamp cutter in accordance with the eighth invention in to the seventh invention is configured as follows. The clamp cutter further comprises cutter urging means for pushing the fixed blade against the movable blade in a direction along the feed-out path.

In the first embodiment (clamp cutter 7), the second moving member 74 is pushed against the outlet guide 76 by the cutter spring 79, serving as the cutter urging means; the movable blade 74*c* is formed in the second moving member 74, and the fixed blade 75 is fixed to the outlet guide 76. The cutter spring 79 is placed between the guide wall 71*b* of the support frame 71 and the outlet guide 76 to exert an urging force toward the upstream side in the feed-out direction of the core fibers.

In the second embodiment (clamp cutter 107), the second moving member 174 is pushed against the outlet guide 176 by the cutter spring 179, serving as the cutter urging means; the movable blade 190 is fixed to the second moving member 174, and the fixed blade 175 is fixed to the outlet guide 176. The cutter spring 179 is placed between the guide wall 171*b* of the support frame 171 and the outlet guide 176 to exert an urging force toward the upstream side in the feed-out direction of the core fibers. This serves to maintain the performance of the cutter in spite of aging.

The clamp cutter in accordance with the ninth invention in the seventh or eighth invention is configured as follows. A first moving member and a second moving member are arranged parallel to each other along the feed-out path. The first moving member is provided with a first passage hole through which the core fibers pass and a projecting portion that projects toward the second moving member. The second moving member is provided with a second passage hole into which the projecting portion is inserted so as to be movable in the direction and through which the core fibers pass. The follower clamp piece corresponds to the projecting portion, while the operating clamp piece corresponds to an area located opposite the projecting portion across the feed-out path in the second moving member.

In the first embodiment (clamp cutter 7), the first moving member 73 and the second moving member 74 are arranged parallel to each other in this order. The first moving member 73 is provided with the first passage hole 73*a*, through which the core fibers pass, and the projecting portion 73*c*, which projects toward the second moving member 74. The second moving member 74 is provided with the second passage hole 74*a*, into which the projecting portion 73*c* is inserted so as to be movable in the direction and through which the core fibers pass. The projecting portion 73*c* serves as the follower clamp piece. The operating clamp piece corresponds to a peripheral part of the clamp surface 74*b* that is an area of the second passage hole 74*a* of the second moving member 74 which is located opposite the projecting portion 73*c* across the feed-out path in the second moving member 74. Then, the projecting portion 73*c* and the peripheral part of the clamp surface 74*b* constitute a clamp sandwiching the core fibers between them.

This keeps the feed-out path of the core fibers airtight. Thus, no problems occur even if the air sucker is used to pneumatically feed out the core fibers along the feed-out path.

A core yarn manufacturing apparatus in accordance with the tenth invention comprises a multi-line draft device that drafts sheath fibers of a core yarn, an elastic yarn supply device that supplies an elastic yarn constituting core fibers of the core yarn, a guide pipe that sets a rush-in position at which the elastic yarn rushes into the draft device, and an air sucker that blows the elastic yarn out of the guide pipe toward the rush-in position. An outlet of the guide pipe is shaped to be elongate in a feed-out direction of the sheath fibers in the draft device.

The core yarn manufacturing apparatus 1 comprises the four-line draft device 100, the elastic yarn supply device 200, and the pneumatic fine spinning device 300. The fine spinning device is not limited to the pneumatic type. The following are arranged between the draft device 100 and the elastic yarn supply device 200 along the feed-out path of the elastic yarn 3: the yarn feeler 5, the air sucker 6, the clamp cutter 7, the nozzle pipe 8, the funnel-like guide 9, and the guide pipe 10.

In the present embodiment, the outlet 10*a* of the guide pipe 10 is elliptical. The major axis of the ellipse extends along the feed-out direction Ds of the sheath fibers 2 in the draft device 100. The shape of outlet of the guide pipe is not limited to the ellipse in accordance with the present embodiment. The outlet may be any linear opening that has a major axis in one direction and a minor axis in a direction perpendicular to this direction; it may be shaped like a fan, a slot (shaped like a rectangle with round corners), or an isosceles triangle. The guide pipe with such an opening which is elongate in one direction may be placed with respect to the draft device so that the longitudinal direction of the opening coincides with the feed-out direction Ds of the sheath fibers 2.

In the above configuration, air ejected from the outlet of the guide pipe is diffused in the feed-out direction of the sheath fibers but not in the axial direction of the front top roller, with respect to the center axis of outlet side of the guide pipe. This stabilizes the behavior of a yarn inserted into the sheath fibers, thus increasing the success rate of insertion of an elastic yarn into the sheath fibers.

The invention claimed is:

1. A core yarn manufacturing apparatus comprising a draft device that drafts sheath fibers of a core yarn and a core fiber supply device that supplies core fibers of the core yarn, the core yarn manufacturing apparatus being characterized in that the core fiber supply device is configured so that a feed-out path of the core fibers in the core fiber supply device is inclined above the draft device in such a manner that a front of the feed-out path is lower than a rear of the feed-out path with respect to a front surface of a machine frame, and in that a wind-out device and a yarn guide are provided in a rear upper part of a base frame of the core fiber supply device, the wind-out device supporting an elastic yarn package and winding out the core fibers constituting an elastic yarn, the yarn guide guiding the core fibers drawn out from a filament yarn package located behind the core fiber supply device, the core fibers constituting a filament yarn, wherein the yarn guide is located behind the wind-out device.

2. A core yarn manufacturing apparatus according to claim 1, characterized by further comprising a moving mechanism that is able to move the base frame upward with respect to the draft device.

3. A core yarn manufacturing apparatus according to claim 1 or claim 2, characterized in that the wind-out device and yarn guide are laid out so that, in the core fiber supply device, a feed-out path of the elastic yarn starting from the wind-out device overlaps a feed-out path of the filament yarn starting from the yarn guide, and in that a clamp cutter for the core fibers and an air sucker that feeds the core fibers out to the clamp cutter are arranged on the feed-out path of the elastic yarn.

4. A core yarn manufacturing apparatus according to claim 1, wherein the core fiber supply device operates in manufacturing a core yarn formed of core fibers covered with sheath fibers, to supply the core fibers, the core fiber supply device being characterized by comprising modules relating to supply of the core fibers and a base frame to which each of the modules is attached, and in that each of the modules is configured to be able to attach to the base frame so as to form an individual unit.

5. A core yarn manufacturing apparatus according to claim 4, characterized in that the modules comprise CSY modules used where an elastic yarn is used as the core fibers and CFY modules used where a filament yarn is used as the core fibers, each CSY module comprises a CSY feed-out device which supports an elastic yarn package and which feeds out the elastic yarn, a CSY clamp cutter, a CSY yarn feeler, and a CSY air sucker, and each CFY module comprises a CFY yarn guide that guides a filament yarn drawn out from a filament yarn package, a CFY clamp cutter, a CFY yarn feeler, and a CFY air sucker.

6. A core yarn manufacturing apparatus according to claim 5, characterized in that the CSY clamp cutter is also used as the CFY clamp cutter, the CSY yarn feeler is also used as the CFY yarn feeler, and the CSY air sucker and the CFY air sucker are selectively attached to the base frame.

* * * * *